US006614019B2

(12) United States Patent
Feller et al.

(10) Patent No.: US 6,614,019 B2
(45) Date of Patent: Sep. 2, 2003

(54) MASS SPECTROMETRY DETECTOR

(76) Inventors: W. Bruce Feller, Nova Scientific, Inc. Sturbridge Business Park 600 Main St., Bldg. 2, Sturbridge, MA (US) 01566-0928; James A. Hill, Nova Scientific, Inc. Sturbridge Business Park 600 Main St., Bldg. 2, Sturbridge, MA (US) 01566-0928; Paul L. White, Nova Scientific, Inc. Sturbridge Business Park 600 Main St., Bldg. 2, Sturbridge, MA (US) 01566-0928; James M. Abraham, Nova Scientific, Inc. Sturbridge Business Park 600 Main St., Bldg. 2, Sturbridge, MA (US) 01566-0928

( * ) Notice: Subject to any disclaimer, the term of this patent is extended or adjusted under 35 U.S.C. 154(b) by 160 days.

(21) Appl. No.: 09/767,615

(22) Filed: Jan. 22, 2001

(65) Prior Publication Data

US 2002/0020817 A1 Feb. 21, 2002

Related U.S. Application Data

(60) Provisional application No. 60/177,172, filed on Jan. 20, 2000.

(51) Int. Cl.[7] ..... H01J 49/40
(52) U.S. Cl. ..... 250/287; 250/397
(58) Field of Search ..... 250/287, 397; 313/105 CM, 103 CM

(56) References Cited

U.S. PATENT DOCUMENTS 5,624,706 A * 4/1997 Goukassian ..... 427/77
5,777,325 A * 7/1998 Weinberger et al. ..... 250/281

OTHER PUBLICATIONS

Kowalski et al., "Quantum efficiency of cesium iodide photocathodes at soft x–ray and extreme ultraviolet wavelengths", Applied Optics, vol. 25, No. 14, Jul. 15, 1986, pp 2440–2446.

Joseph L. Wiza, "Microchannel Plate Detectors", Nuclear Instruments & Methods, vol. 162, Nos. 1–3, Part II, Jun. 1–15, 1979, pp 587–601.

Verentchikov et al., "Detection of large molecular ions by secondary ion and secondary electron emission", Int. J. Mass Spectom. Ion Processes 126 (1993) 75–83.

Hemphill et al., "Chemical method to increase extreme ultraviolet microchannel–plate quantum efficiency", Applied Optics, vol. 36, No. 7, Mar. 1, 1997, pp 1421–1426.

Schedin et al., "Windows and photocathodes for a high resoluton solid state bandpass ultraviolet photon detector for inverse photoemission", Rev. Sci. Instrum. 68(1), Jan. 1997, pp 41–46.

Midorikawa et al., "An Optical Field–Induced Ionization X–Ray Laser Using a Preformed Plasma Scheme", IEEE Journal of Selected Topics in Quantum Electronics, Vol. 1, No. 3, Sep. 1995, pp 931–940.

(List continued on next page.)

*Primary Examiner*—Jack Berman
(74) *Attorney, Agent, or Firm*—Fish & Richardson P.C.

(57) ABSTRACT

Detection systems for mass spectrometry involving a combination of novel detector face coatings, repeller grid position and voltage, and in some embodiments employing tandem detectors, an interplate voltage. The mass spectra show improved sensitivities to high mass ions.

28 Claims, 20 Drawing Sheets

OTHER PUBLICATIONS

Fiorito et al., "Polarized angular distributions of parametric x radiation and vacuum–ultraviolet transition radiation from relativistic electrons", Physical Review E, vol. 51, No. 4–A, Apr. 1995, pp. 2759–2762.

Nagata et al., "Production of an extremely cold plasma by optical–field–induced ionization", Physical Review A, vol. 51, No. 2, Feb. 1995, pp 1415–1419.

Aleksan et al., "Quantum efficiency and ageng studies for bulk and porous CsI photocathodes in a MWPC", Nuclear Instruments & Methods In Physics Research, Feb. 21, 1994, vol. 340, No. 2, pp 293–303.

Lees et al., "In vacuo stability of CsI–coated microchannel plates in the presence of water vapour and organic contaminants", Nuclear Instruments & Methods In Physics Research, Aug. 15, 1993, vol. 332, No. 3, pp 570–574.

Akkerman et al., "Ultrafast secondary emission X–ray imaging detectors: A possible application to TRD", Nuclear Instruments & Methods In Physics Research, May 1, 1992, vol. A315, Nos. 1–3, pp 82–91.

Siegmund et al., "Extreme ultraviolet quantum detection efficiency of rubidium bromide opaque photocathodes", Applied Optics, vol. 29, No. 31, Nov. 1, 1990, pp 4677–4685.

Nakai, "Inertial Confinement", Nuclear Fusion, vol. 30, No. 9, Sep. 1990, pp 1863–1878.

Siegmund et al, "Soft x–ray and extreme ultraviolet quantum detection efficiency of potassium chloride photocathode layers on microchannel plates", Applied Optics, vol. 27, No. 20, Oct. 15, 1988, pp 4323–4330.

* cited by examiner

MASS SPECTROMETRY DETECTOR

This application claims the benefit of U.S. Provisional Patent Application Ser. No. 60/177,172, filed Jan. 20, 2000, which is hereby incorporated by reference in its entirety.

TECHNICAL FIELD

This invention relates to detection of charged and neutral molecules and fragments, and more particularly to the detection of such species generated in a mass spectrometer.

BACKGROUND

Mass spectrometry is an analytical technique for the determination of molecular weights, the identification of chemical structures, the determination of the composition of mixtures, and qualitative elemental analysis. In operation, a mass spectrometer generates ions of sample molecules under investigation (the analyte), separates the ions according to their mass-to-charge ratio, and measures the relative abundance of each ion.

Mass spectrometry involves introducing a sample presentation apparatus into the mass spectrometer, volatilizing and ionizing the analyte, accelerating the ionized analyte toward a detector by exposing the ions to an electric and/or magnetic field, and analyzing the data to determine the mass to charge ratio (m/q) of specific analyte ions. If the analyte remains intact throughout this process, data obtained will correspond to a molecular weight for the entire intact analyte ion. Typically, however, and especially for the case of larger biological analytes, it is beneficial to obtain data corresponding to the molecular weight of various fragments of the analyte. It is also desirable to obtain data which only corresponds to the pure analyte, even when impurities are present.

Mass spectrometry techniques include quadrupole, magnetic sector and time of flight (TOF) methods. Time of flight mass spectrometry (TOF) is a technique that separates different ion mass by a time coordinate. First, ions are accelerated across a given voltage so that they will attain common kinetic energies. Thus, ions of different mass/charge ratio (m/q) will attain different velocities. If these ions are allowed to drift, they will spread out in space, and the lightest (and fastest) ions will arrive at the detector first. A time-sensitive detection system can be used to reconstruct a mass spectrum. TOF mass spectrometers are advantageous because they are relatively simple, inexpensive instruments with virtually unlimited mass-to-charge ratio range. TOF mass spectrometers have potentially higher sensitivity than scanning instruments because they can record all the ions generated from each ionization event. TOF mass spectrometers are particularly useful for measuring the mass-to-charge ratio of large organic molecules where conventional magnetic field mass spectrometers can lack sensitivity. TOF mass spectrometers are shown, for example, in U.S. Pat. Nos. 5,045,694 and 5,160,840.

TOF mass spectrometers include an ionization source for generating analyte ions. The ionization source contains one or more electrodes or electrostatic lenses for accelerating and properly directing the ion beam. In the simplest case the electrodes are grids. A detector is positioned a predetermined distance from the final grid for detecting ions as a function of time.

Matrix-assisted laser desorption/ionization (MALDI) is a technique to volatilize and ionize biological molecules in a mass spectrometer which uses TOF techniques. MALDI involves surrounding a biomolecule with a matrix material.

A laser beam, tuned to a frequency where the matrix material absorbs, is targeted on the matrix material. The laser transfers sufficient energy to volatilize a small portion of the matrix material. A small number of analyte molecules are thus carried along with the matrix material into the vapor phase in the mass spectrometer.

TOF systems have used electron multiplier detectors of several types, including box-and-grid, Venetian blind, magnetic strip and single channel electron multipliers. In these, rise times can be too long to resolve close-lying mass peaks. Electronic gating has been used to measure only a single m/q for each ion group, with the interval for detection advanced stepwise for subsequent ion-generating pulses. Covering the entire mass range for a given sample requires a very large number of pulses and consequently long measurement times. As mass spectrometry is a destructive analytical technique, precious samples were sacrificed for these measurements as well.

A microchannel plate (MCP) detector is a wafer-like lead glass microchannel device with superior timing resolution (<1ns rise time) that can alleviate these problems. MCP allows the detection of all m/q values in a single ion-generating pulse. This advance motivated parallel advances in other areas of TOF, such as mass resolution. Further background on MCP detectors is found in J. L. Wiza, *Nucl. Instr. Meth.,* 162, (1979) p 587.

TOF is used in biomedical research and clinical applications, commonly through laser desorption ionization (MALDI) and electrospray ionization techniques. However, very low detector efficiency for such ions can become a limiting factor. Ion detectors not suited for efficient detection of high mass biomolecular ions hinder accurate mass analysis of proteins and other biomolecules of importance to biochemistry, modem biology, and medical science.

Although the timing problem has been improved with the MCP, other detector limitations can limit TOF mass spectrometry. These drawbacks include poor sensitivity to high-mass ions and inadequate dynamic range. One way to increase detector sensitivity is to increase the incident ion postacceleration voltage to 25 or 35 kV or more to increase ion yields and detector signal levels.

SUMMARY OF THE INVENTION

The invention provides detection of molecules in mass spectroscopy instruments. In embodiments, significant improvements in detection sensitivity can result from the use of a repeller grid placed in the vicinity of the detector face, particularly in combination with a coating of low work function material on the detector face, the coating being of a relatively low density. A further improvement in signal can be produced by utilizing a negative interplate bias when detectors are used in a tandem configuration. The detection signal generated by detectors utilizing this combination of features is superior to that of detectors without either feature, or with each feature utilized independently. The combination of features provides a synergistic effect in producing a detection signal.

The detection system offers superior detection sensitivity for high mass ions over conventional detection systems. The detection system obviates complex detector manufacturing methods considered necessary for obtaining acceptable sensitivity. Moreover, the detection system, when used in a tandem configuration, further improves detection efficiency of high mass ions by reducing the interfering light mass matrix ion signal which is found in MALDI techniques.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

Other features and advantages of the invention will be apparent from the following detailed description, and from the claims.

DETAILED DESCRIPTION

The detection systems are designed to detect charged and neutral molecules and molecular fragments. A source of such molecules and/or fragments can be generated by a number of methods, for example, as described in A. Benninghoven, ed., *Ion Formation from Organic Solids*, Springer-Verlag (1983), pp. 32 and 90. Of particular interest are charged and neutral molecules and fragments as generated in mass spectrometer instruments.

Provision of a field grid can provide a very powerful synergy when combined with the MCP input coatings (described below), particularly when the field strength and spacing are selectively configured. A dramatic enhancement of the MCP detection sensitivity to high mass ions results when this is done as the field strength used approaches either positive or negative 200 V/mm or values more positive or negative, respectively.

Figure 1:
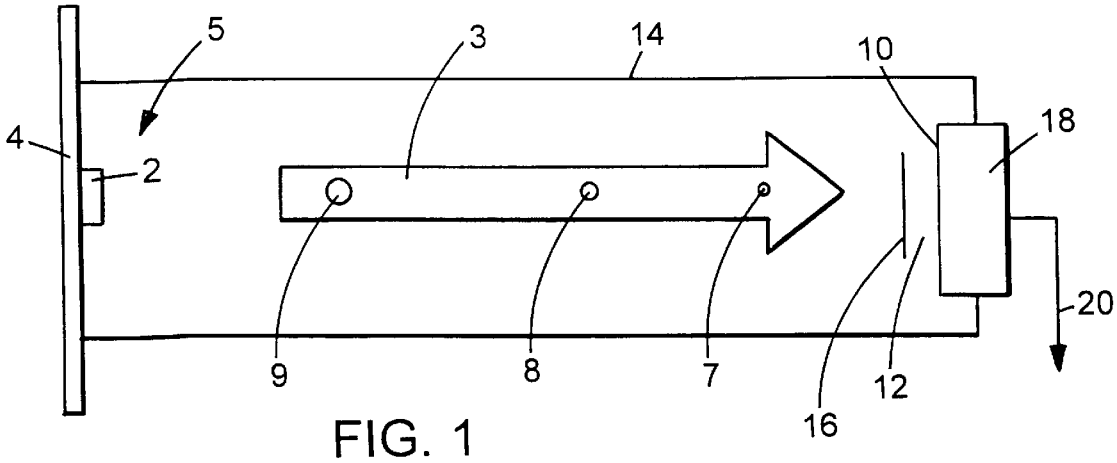
FIG. 1 is a schematic illustration of relevant structural features of a mass spectrometer detection system according to an embodiment of the invention.

FIG. 1 schematically illustrates structural features of a mass spectrometer employing the detection system according to certain embodiments of the invention. Quadrupole and magnetic sector analysis type mass spectrometers can be used in conjunction with the present invention, but TOF mass spectrometers are preferred for high mass biological molecules. Suitable TOF mass spectrometers are described generally in Erich W. Blauth, *Dynamic Mass Spectrometers*, Elsevier (1965), p. 71. A beam of ions 3 (positive or negative) arising from sample 2 mounted on sample stage 4 is provided by an ion source 5. In some preferred embodiments, the beam comprises biomolecular ions. The beam contains ions of differing mass, some light ions 7, some heavier ions 8, and some still heavier ions 9. The beam 3 proceeds down drift tube 14. The ion beam impinges a detector face 10, on detector 18 as shown. In TOF instruments, the timing of the arrival of a given group of ions is related to the mass to charge ratio of the ion. The time of signal 20 is thus indicative of the mass to charge ratio.

A particular feature of the detection system is the presence of an electric field 12 in the immediate vicinity of detector face 10. The electric field 12 is established by repeller grid 16.

Figure 2:
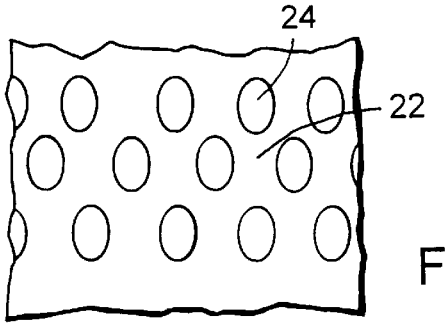
FIG. 2 is a schematic illustration of an interchannel web on a detector face.

As shown schematically in FIG. 2, the walls 22 of the individual channels 24 which make up the channel plates of an MCP detector are of finite width and thus form an interchannel web. Molecules or fragments incident on the web are not necessarily detected. Thus, the webbed feature of MCP construction inherently limits effectiveness. To overcome this limitation, manufacturing schemes to decrease the area of this web have been attempted, such as using funneled channels or square channels. Typical round-pore MCP detectors have a channel open area of 65%, the web covering 35% of the face.

Figure 3:
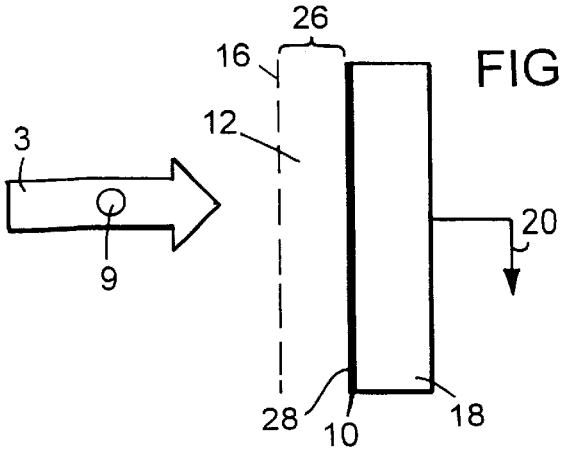
FIG. 3 is a schematic illustration of a repeller grid placed before a detector face according to an embodiment of the invention.

The detection system can render such complex manufacturing procedures unnecessary, or further improve detector performance when such procedures are employed. When MCP detectors are bombarded with incident particles (that is, photons, electrons or ions), secondary electrons are ejected from the material coating the web. Using an electric field applied between the input face of the MCP and a grid placed just adjacent the face, these ejected electrons will be returned to the MCP surface and be detected, thus enhancing the signal. If the front of the MCP is coated with a material having a high electron yield, the web can contribute more to the detector's efficiency than the channels that are directly hit by the incident particles. This arrangement is shown in FIG. 3. Ion beam 3, containing heavy ion 9 passes through repeller grid 16, and experiences electric field 12. Repeller grid 16 is placed a distance 26 from detector face 10 of detector 18. Detector face 10 is coated with coating material 28, to be described below.

For high mass ion detection, secondary particles such as positive and negative secondary (daughter) ions may be emitted from the interchannel web area, due to sputtering and/or dissociation processes.

The incident ion detection efficiency varies with the applied electric field, in both magnitude (applied voltage) and direction (polarity). For negative fields, there may be a Schottky lowering of the potential barrier of the coating material on the web. This results in enhancement of the secondary electron yield of the photocathode material, and may also influence sputtering and dissociation processes.

For grid voltages corresponding to negative field values, the zero-potential field surface penetrates into the channel throat. As the field is increased, the zero-potential field surface moves out of the channel throat, and more emitted electrons from the throat are counted. Although not wishing to be bound by the operation, negative grid potential relative to the MCP input would repel interchannel electrons and secondary negative ions back into the MCP channels, adding to the detected signal. However, it would at the same time attract any positive secondary ions created in the interchannel web area back to the grid, diminishing their contribution to the signal. Conversely, changing the grid voltage from a negative to a positive bias relative to the MCP input face provides an electric field that would accelerate electrons and any negative secondary fragment ions back towards the grid. This would thus exclude the contribution of negatively charged interchannel electrons and ions to the MCP signal.

With respect to the repeller field, there are three parameters to be adjusted, the applied voltage, the polarity and the distance from the detector face. The voltage of this grid can be biased negatively, with a field value of from about −200 to about −500 V/mm. For example, the grid can be placed 4 mm in front of the detector face, with a field value of −1400 V. Other combinations of voltage and distances can be used which give negative V/mm field strengths in the desired range. For example, the distance from the detector face can vary from about 100 $\mu$m to about 8 mm, or from about 1 mm to about 6 mm. The voltage of this grid can also be biased positively, with a field value of from about 200 to about 500 V/mm. For example, the grid can be placed 4 mm in front of the detector face, with a field value of about 1400 V. Other combinations of voltage and distances can be used which give positive V/mm field strengths in the desired range. For example, the distance from the detector face can vary from about 100 $\mu$m to about 8 mm, or from about 1 mm to about 6 mm.

Another feature is a coating on the detector face. The coating serves as a low work function material on the face of an MCP detector used for mass spectroscopy. In particular embodiments employing the combination of a repeller field adjacent the detector face, and the detector face coating described herein, increases in sensitivity may be achieved, indicating a synergistic effect of these features. Low work function materials are those having a work function below about 3.5 eV, for example below about 3.0 eV or below about 2.8 eV.

A number of materials are suitable as low work function coating materials on MCP detector faces. Each material has its own spectral region of optimal efficiency. The coating materials can include halides of group IA and group IIA alkali and alkali earth elements. These specifically include CsI, CsBr, CsCl, KBr, KI, KCl, RbI, RbBr, RbCl, LiF, NaI, NaBr, $MgF_2$ and the like, as well as materials such as CuI. Materials considered desirable include CsI and KBr. A particularly desirable material is KBr.

The coating materials are deposited on the detector face so as to produce coating thicknesses of between about 3 and about 10 $\mu$m, preferably between about 5 and about 10 $\mu$m. The densities of the coatings are low, and the appearance of such coatings by scanning electron microscopy (SEM) is mottled, rough and spongelike. This leads to the coatings being referred to as "fluffy" coatings. Detectors having faces with "fluffy" coatings of halides of group IA and group IIA alkali and alkali earth elements have been found to produce highly sensitive responses, particularly to high mass ions. Although not wishing to be limited by operation, sensitivity of the detector system may be increased by the increased surface area of coating material, alternatively or additionally due to sputtering of the coating material. Although these materials are generally quite hygroscopic, excellent results can be obtained by carrying out a bakeout procedure and avoiding exposure of the coatings to a humid atmosphere.

Surface mass density values for the coatings can range from about 50 $\mu g/cm^2$ to about 2000 $\mu g/cm^2$, preferably from about 50 $\mu g/cm^2$ to about 1000 $\mu g/cm^2$, or more preferably from about 100 $\mu g/cm^2$ to about 1000 $\mu g/cm^2$.

The coatings are deposited in the following general manner. A measured weight of solid state halides of group IA and group IIA alkali and alkali earth elements are sublimed in a bell jar using an electrically heated metal boat. The MCP detector face to be coated is mounted above the boat, and is screened from the boat by an openable shutter. The coating angle between the detector face normal and the boat is maintained at 0°. The bell jar is pumped to a low pressure (for example, about 10 $\mu$m Hg), and filled with several Torr of an inert gas. Water vapor absorbed on the alkali halide or alkali earth halide material is allowed to evaporate by slight heating, after which the material is further heated, the shutter opened and the material allowed to condense onto the detector face. When the measured amount of material is no longer present in the boat, the heating is discontinued and the bell jar allowed to cool. The coated detector face is kept from humidity, preferably in a glove box or dessicator. Information about "fluffy" coatings is available, for example, in Kowalski et al., *Appl. Optics,* 25, (1986) 2440. "Fluffy" coatings can be purchased commercially, for example, from Ball Aerospace (Boulder, Colo.).

One important process parameter for the coating techniques is the deposition time. The coating material is desirably deposited for less than about 8 minutes, more desirably deposited for less than about 6 minutes and even more desirably deposited for less than about 4 minutes.

Figure 4:
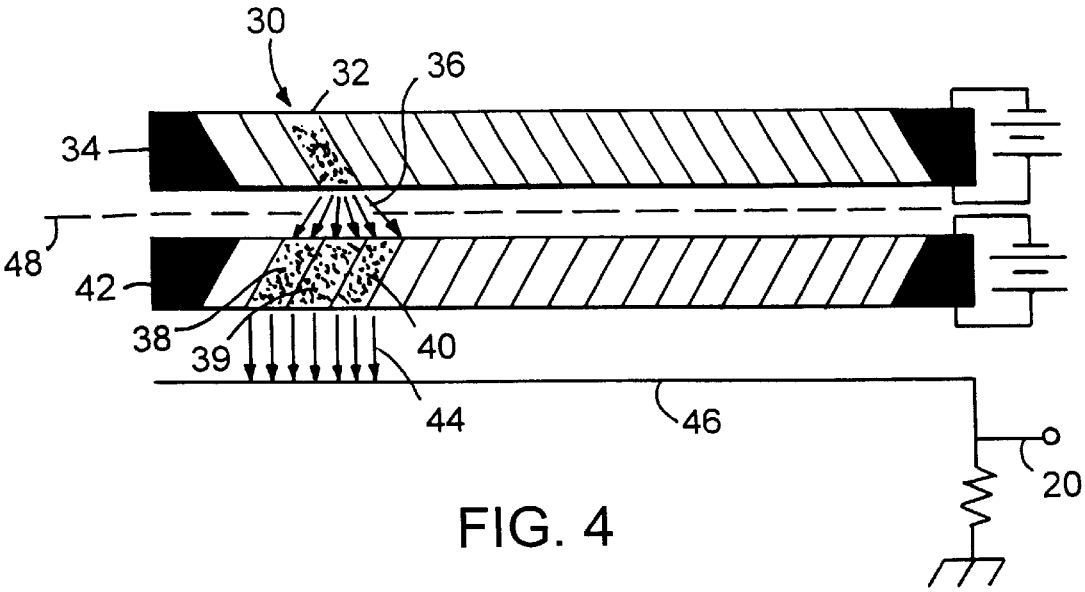
FIG. 4 is a schematic illustration of a tandem detector configuration according to an embodiment of the invention.

Another feature can be used when MCP detectors are used in tandem, or "chevron" configuration. Although single MCP detectors are suitable ion detectors, a common format is the juxtaposition of two MCP detectors together in tandem, as shown in FIG. 4. Primary impact particle 30 (which can be an electron, ion, or neutral species) contacts a particular microchannel 32 of leading MCP 34, causing a cascade of secondary electrons 36. These secondary electrons 36 are emitted from leading MCP 34 and are incident on individual microchannels 38, 39 and 40 of trailing MCP 42, each microchannel producing a similar cascade of tertiary electrons 44, which are subsequently incident on metal anode 46, which produces signal 20. An interplate bias grid 48, producing an interplate bias, can also be employed, as described below.

The chevron configuration is primarily used to boost the detector signal and reduce ion feedback processes which degrade the signal-to-noise of solitary MCP detectors. The gain of a tandem MCP is ~$10^6$–$10^7$ (as compared to the gain of ~$10^4$ for a single MCP). The detector separation is typically about 50–150 $\mu$m.

One important consideration is dynamic range, or the ability to respond linearly to increasing input flux. Typically, the count rate, or dynamic range capability of a chevron configured detection system is poorer than that of a single MCP of comparable LID and pore size, since the charge exiting a single channel in the chevron input plate is shared by several channels in the output MCP detector. Also, the gain of chevrons tends to be considerably higher than for single MCP detectors, slowing the channel recharge process and further degrading dynamic range.

The ions arising from high mass biological molecules may not be optimally detected in the chevron configuration. In MALDI experiments, the incoming ion bursts can have an approximately 100–200 microsecond leading edge composed of low mass ions arising from the matrix material. These may saturate and render inactive MCP microchannels, which typically have deadtimes of roughly 100 milliseconds or more in the tandem MCP configuration. Hence, the more slowly-moving, and later-arriving high-mass ions of interest reach the detector during this deadtime period, and are detected poorly.

The detection system, when configured in a tandem MCP configuration, employs a negative voltage gradient between the two MCP in the chevron, through the introduction of an interplate bias grid. The use of a negative interplate bias voltage effectively repels much of the emitted electron cascade from the MCP which results from the light ion impact, but selectively passes the electron cascade resulting from high ion impact. Although not wishing to be bound by operation, the effectiveness of this approach may arise from the generation of secondary, or daughter, ions upon impact of the parent ion with the leading MCP. Since TOF mass spectrometry differentiates mass-to-charge ratios along a temporal coordinate, the fact that fragmented ions cause detection would not significantly affect the determination of mass spectra under such a theory.

The negative voltage gradients to be imposed between the leading and trailing MCP detectors in a chevron detector configuration can range from about −100 to about −500 V/mm.

The invention will be further described in the following examples, which do not limit the scope of the invention described in the claims.

EXAMPLES

Figure 5:
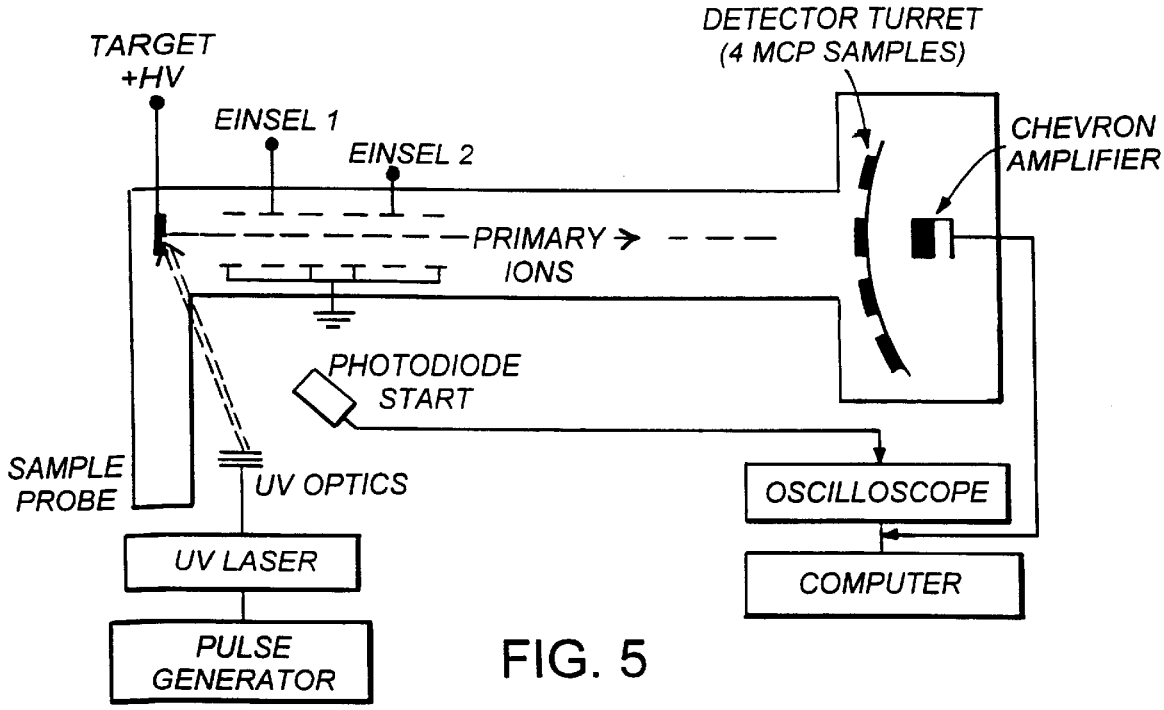
FIG. 5 is a schematic illustration of a test system used for testing some of the embodiments of the invention.

The following examples illustrate the advantages and properties of some embodiments of the invention. The test system is described, and illustrated in FIG. 5. The system incorporates a nitrogen laser (labeled UV laser), suitable monitoring equipment for the beam and sample, a sample holder and ionization stage, appropriate ion lensing, flight tube, turret detector flange, and all necessary vacuum support equipment and electronic signal processing. The test system was to be capable of mounting specially modified but standard format (32.74 mm OD) MCP detectors (Burle LONG-LIFE MCP; Burle Electrooptics, Inc., Sturbridge, Mass.) into a turret system so that multiple detector face plates could quickly and easily be changed for testing.

Figure 6:
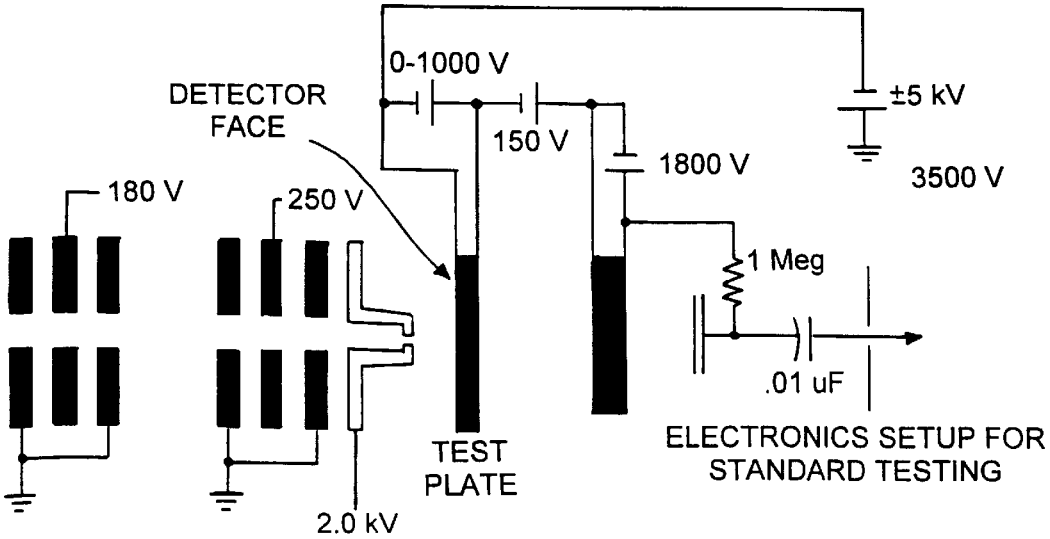
FIG. 6 is a schematic illustration of the electronic components for a detector according to an embodiment of the invention.

FIG. 6 shows more detail, specifically, a 1.65 meter linear TOF mass spectrometer with a MALDI ion source, and a specialized detector assembly. The source consists of a sample stage and two acceleration plates and two einzel lenses for focusing the ion beam.

The first einzel lens is a standard three-plate lens and the second einzel lens has a trisected center element that can be used to help align the beam onto the detector. No deflection plates were used, and the detector turret is aligned with the centerline of the flight tube. The ion source also has a cesium ion gun mounted on the back of the sample stage that can be used when the sample probe is removed to test the detector gain and the source alignment. The detector consists of two 25 mm MCP detectors mounted together in a chevron configuration with a single anode mounted in back with a coaxial cable and feedthrough connecting to a Tektronix 500 MHz digital oscilloscope. In front of the chevron is a rack that contains holders for 4 MCP detectors, each functioning as a high mass ion converter which then has the electron signal pulse amplified by the chevron MCP amplifier.

The front MCP turret can be moved by a linear vacuum feedthrough to position one of four MCP detectors into the ion beam path for testing. The MCP detectors can be interchanged in a few seconds without venting the vacuum system, thus allowing for a comparison of the detectors with the same sample under identical experimental conditions. The power supplies for the detector are all bipolar and their outputs isolated from ground, allowing for a variety of detector configurations that can be tested, including AC and DC coupled anode outputs. Typically, DC coupling was used for all tests with incoming positive analyte ions. For detection only of neutral species, where positive incoming ions were to be deflected away from the detector, AC coupling had to be used in order to allow the leading MCP detector voltage to be biased more positive than the incoming ion energy, in order to repel it.

The main analytes used for comparative testing were Substance P (1348 Da) and Bovine Serum Albumin (BSA, 66,320 Da). Use of the BSA sample also provided a useful dimer peak at 132,469 Da, in addition to the main peak (M+) at 66,230 Da. The M+ and M2+ dimer peak ratios have been shown to be a good measure of the relative sensitivity of modified MCP detectors, and is a key criterion for initial comparisons with standardized MCP detectors. Throughout all examples reported, only positive sample ions were produced (as in virtually all MALDI studies reported in the literature). All samples were dissolved in a saturated aqueous solution of 2,5-dihydroxybenzoic acid (DHB). Several $\mu$L of the resulting solution were applied along the 5×40 mm target area of the probe and allowed to dry in air. The probe could then be translated, allowing different sample deposits to be irradiated by the beam of a UV laser (Laser Science, Inc., model VSL-337ND) shining through a vacuum window. The samples were illuminated at ~1 Hz with roughly 4 ns wide pulses from the $N_2$ laser. An area of intense signal was located and then the first MCP detector was tested, summing from 10–20 laser shots. Then the laser was stopped and the next MCP detector was placed in position and tested. The changing of the MCP detectors to be tested only took a few seconds and the original MCP detector was always retested to make sure the sample had not degraded.

The ion optics of the instrument are such that the ion beam energy can be set from a few hundred eV up to 30 keV. The front face of the detector can be varied anywhere from +8 kV to −8 kV. This allows for a wide range of experiments with ions of varying energies striking the detector, as well as experiments with neutral species. The versatility of the detector assembly with the ability to change test plates quickly has proven to be very useful, as ion intensity can be held constant during the experiment, giving faster and more accurate comparisons. Recently, modifications to the detector power supply have been implemented to quickly increase the high voltage to the MCP detector after the matrix ions strike the detector. This lessens the "saturation effect" of the MCP detector and increases the sample ion signals.

MALDI testing was generally carried out for all tests discussed below at a leading MCP voltage bias of 800 V for the converter, unless otherwise specified. The chevron trailing amplifier section was run at 1800 V, normally using a +150 V converter-to-chevron "interplate" bias, unless otherwise specified. Both Substance P and BSA were used as sample ions, as well as neutral ion sources. Comparisons were made with a standard product MCP. When Substance P was run at 20 kV, no difference was seen between standard and any of the coated plates, all performing roughly the same. However, when the accelerating voltage was lowered to 2.5 kV, the coated MCP detectors performed better than the standard MCP detectors for each of the coatings. Finally, when BSA was run at 20 kV acceleration voltage, the standard MCP detector performed much better than all of the coated plates, with the latter giving essentially no signal.

Figures are reported with arbitrary units for spectral intensity, and the time axis as 10 $\mu$s per major division.

Example 1

Grid Enhancement of MCP Sensitivity

The following data show the improvement resulting from placement of a repeller grid in close proximity (4 mm away) to a "fluffy" alkali halide coated MCP compared to a similarly coated MCP without any grid voltage.

Figure 7:
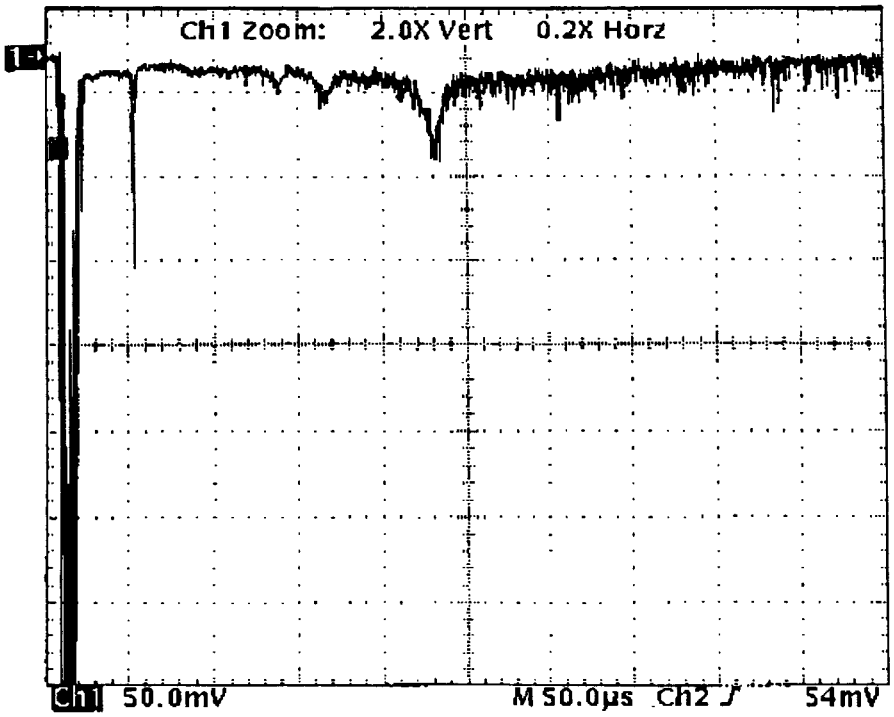
FIG. 7 is a mass spectrum for BSA with no repeller grid voltage.
Figure 8:
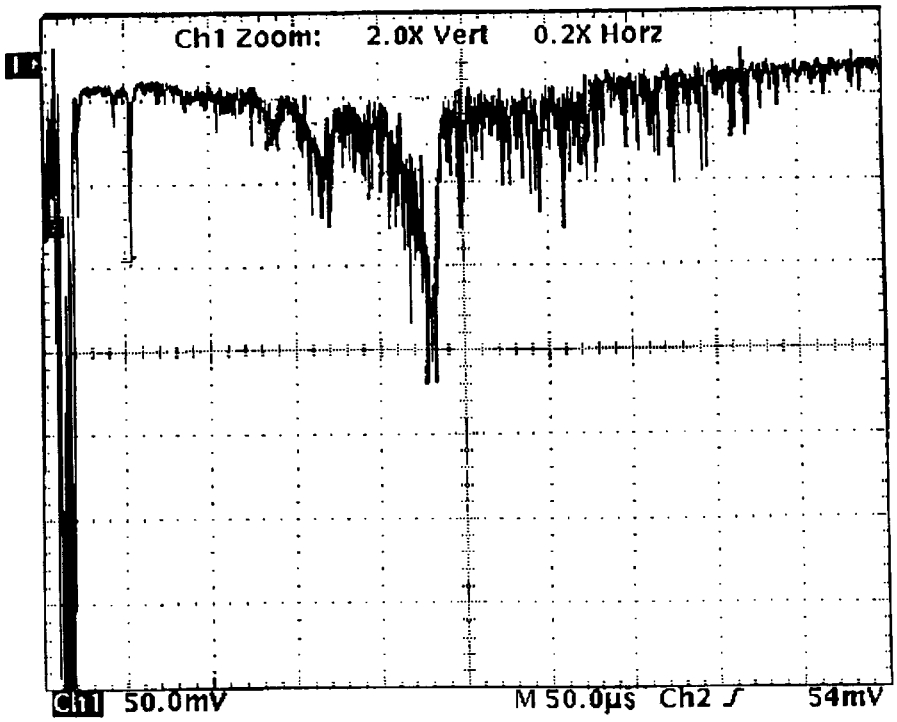
FIG. 8 is a mass spectrum for BSA according to a particular embodiment of the invention.
Figure 9:
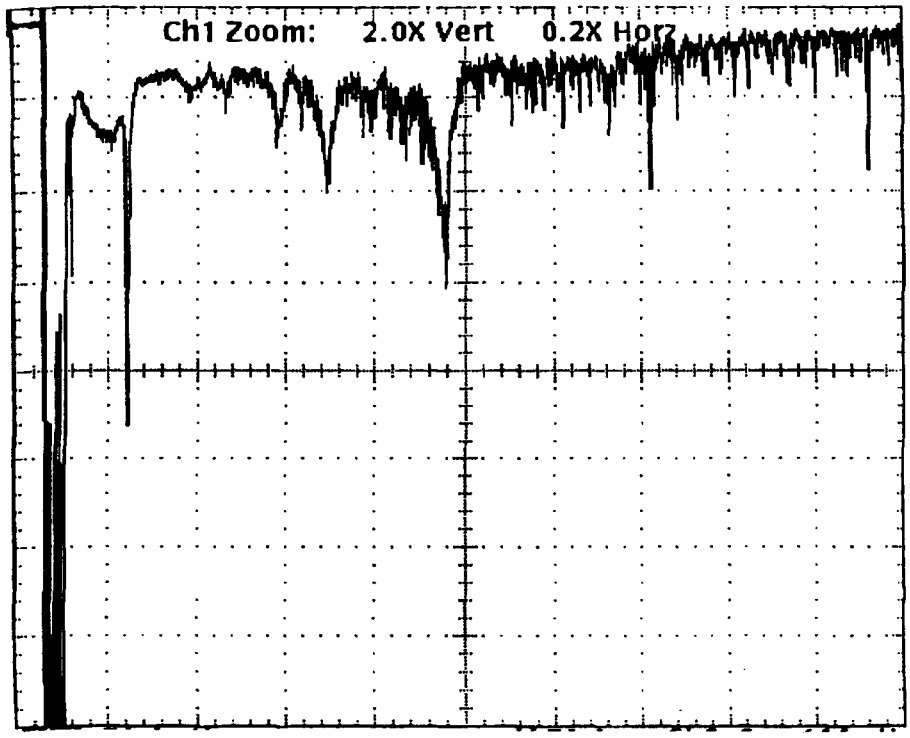
FIG. 9 is a mass spectrum for BSA according to a particular embodiment of the invention.
Figure 10:
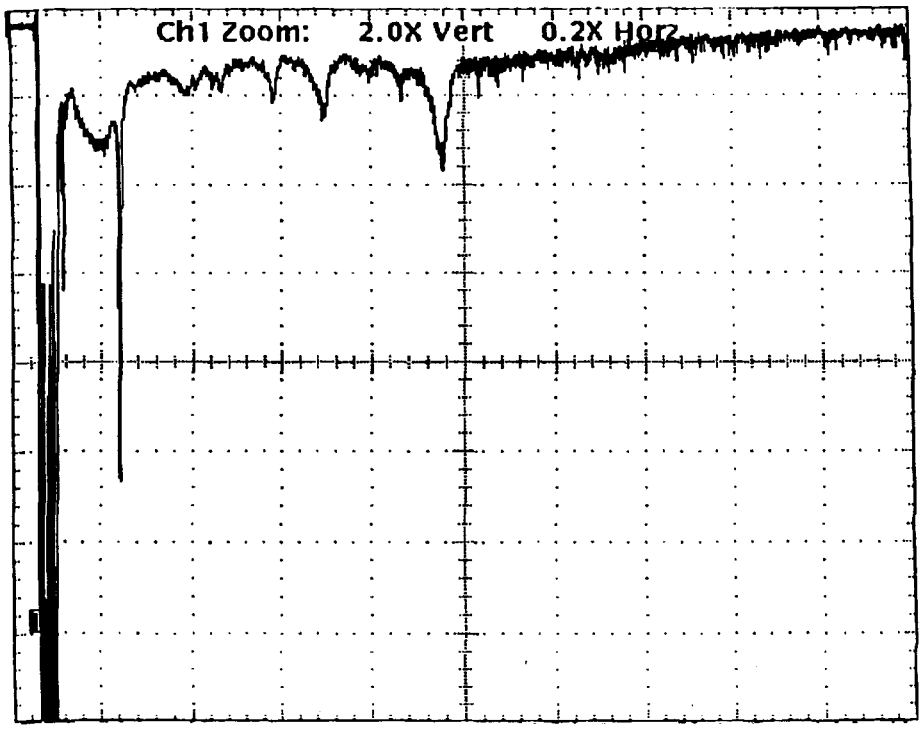
FIG. 10 is a mass spectrum for BSA with no repeller grid voltage.
Figure 11:
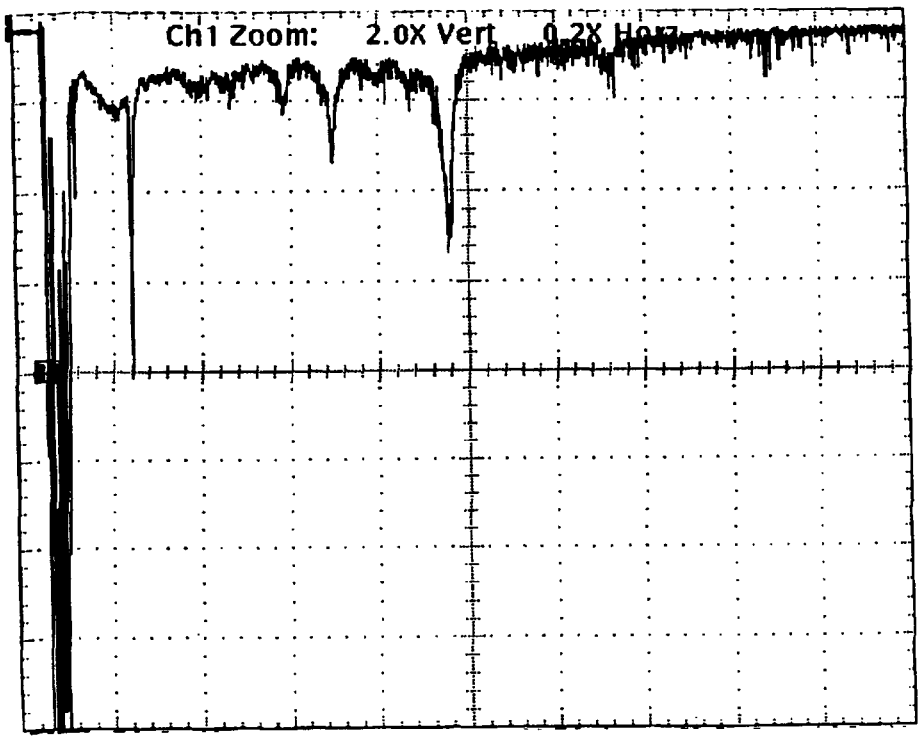
FIG. 11 is a mass spectrum for BSA according to a particular embodiment of the invention.

FIG. 7 shows a mass spectrum for BSA (66 kDa) at 20 kV, using a first fluffy CsI-coated MCP with the repeller grid off (0 V). FIG. 8 shows the dramatic improvement in signal as the repeller grid is biased negatively (−1400 V; equivalent to −350 v/mm). Further spectra were recorded, using BSA at 20 kV, using the first fluffy CsI-coated MCP at −1400 V, as in FIG. 9. FIG. 10 shows a 0 V mass spectrum. When the grid polarity was shifted to +1400 V, the mass spectrum of FIG. 11 was recorded. Both a positive and negative grid potential enhanced the mass spectra as compared with no voltage applied to the grid.

Figure 12:
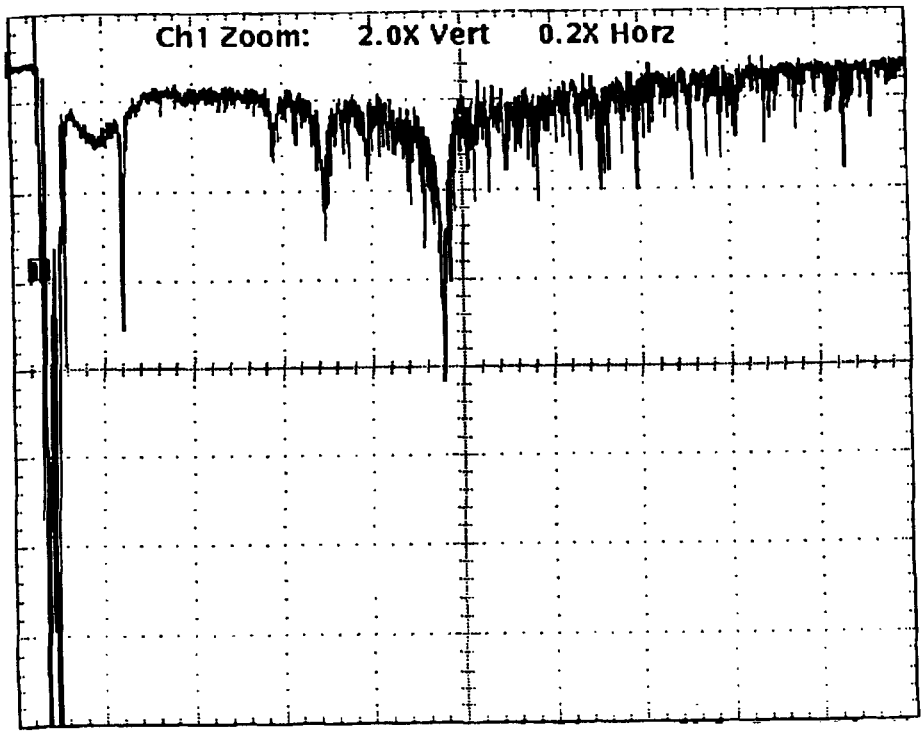
FIG. 12 is a mass spectrum for BSA according to a particular embodiment of the invention.
Figure 13:
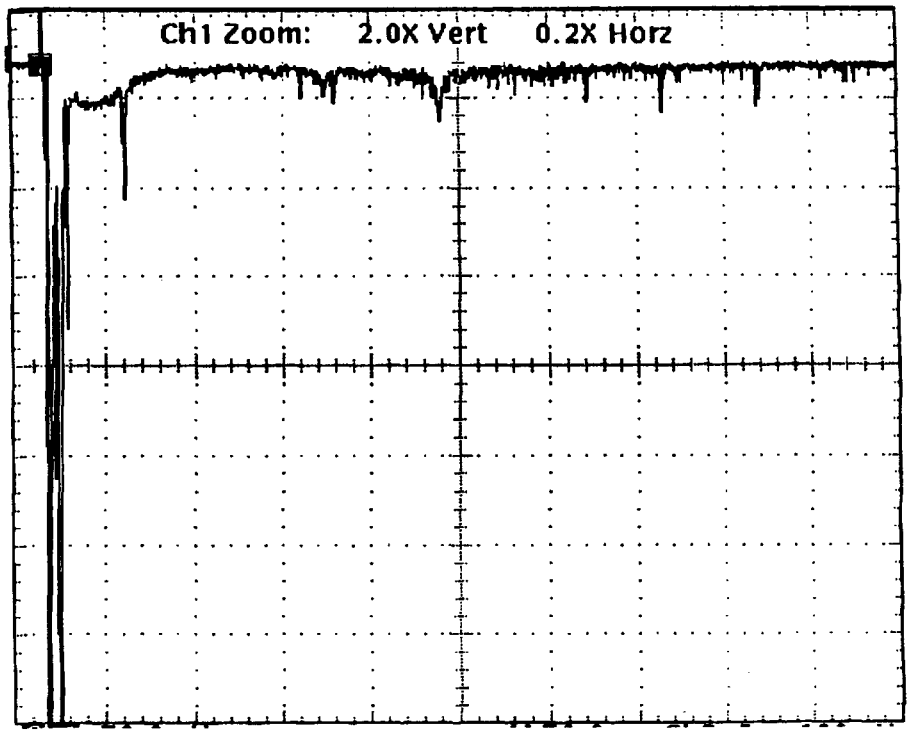
FIG. 13 is a mass spectrum for BSA according to a particular embodiment of the invention.
Figure 14:
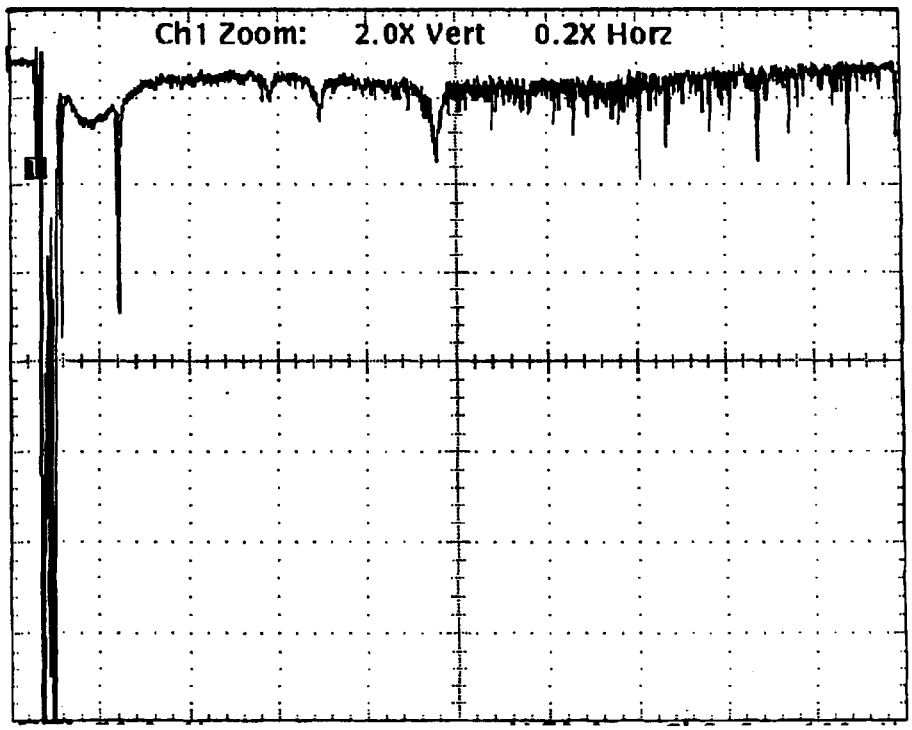
FIG. 14 is a mass spectrum for BSA with no repeller grid voltage.

A second fluffy CsI-coated MCP detector face was prepared and exposed to humidity, showing a striking difference noted in the BSA mass spectra as the polarity was shifted from −1400 V to +1400 V. FIG. 12 shows the effect on the mass spectrum at −1400 V, and FIG. 13 shows the +1400 V spectrum, and FIG. 14 shows the 0 V spectrum. The effect of moisture on the fluffy CsI severely dampened the +1400 V response, without any real effect on the −1400 V or 0 V mass spectra. The essentially equivalent peak heights of the low mass matrix ions in the left region of the spectra suggest that an important mechanism is at work combining the effects of moisture and positive repeller grid voltage, impacting the higher mass ion response.

Figure 15:
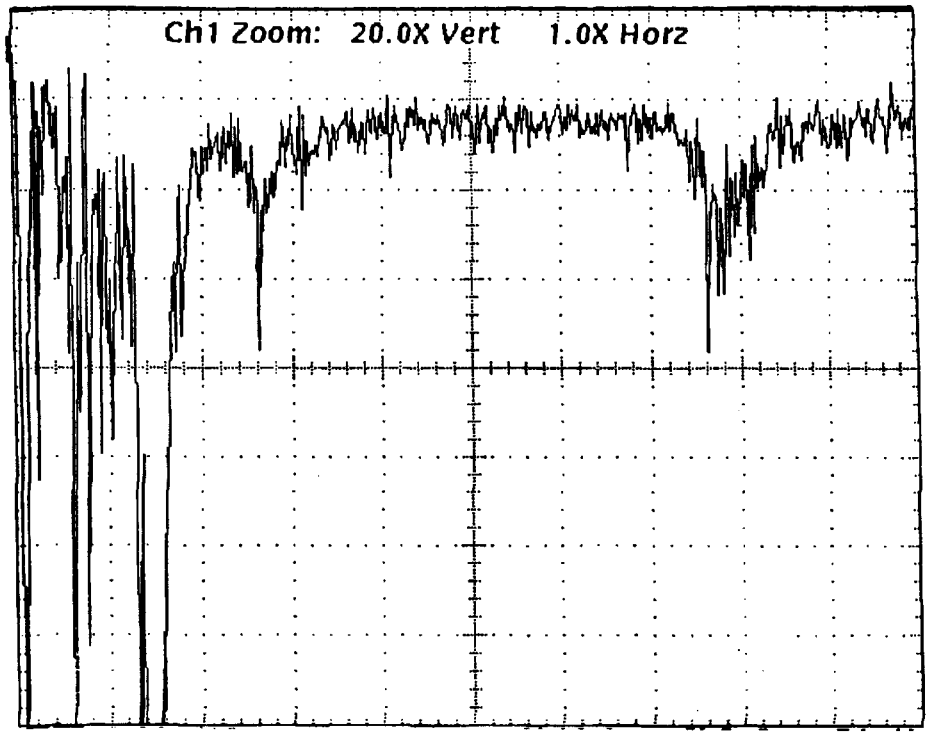
FIG. 15 is a mass spectrum for Substance P according to a particular embodiment of the invention.
Figure 16:
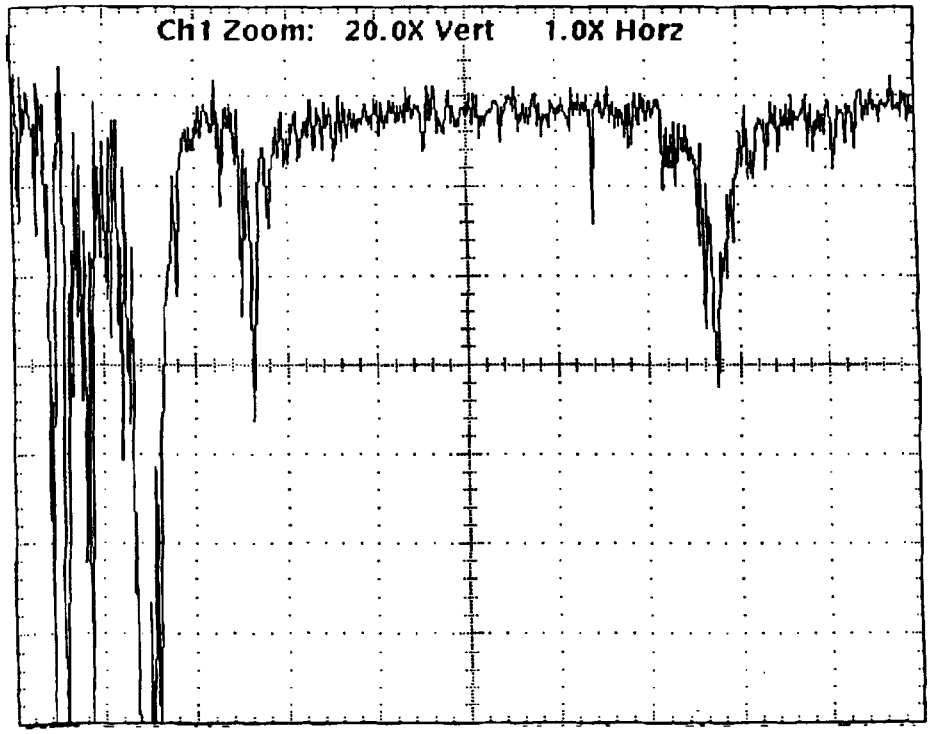
FIG. 16 is a mass spectrum for Substance P with no repeller grid voltage.

Neutral molecule fragments from Substance P were also investigated. The accelerating voltage was lowered to 2.5 kV, and the leading MCP voltage was raised to +3100 V in order to repel any positive ions, whenever the grid was at 0 V. When the grid was at −1400 V, the leading MCP detector face was raised to a +4500 V bias, to preserve the repulsion effect on the incoming 2.5 kV positive ions (where the −1.4 kV grid voltage would increase the ion energy to 3.9 kV, requiring a stronger repelling voltage at the MCP detector face). FIG. 15 shows the mass spectrum of a −1400 V repeller grid bias, and FIG. 16 shows the mass spectrum of a 0 V repeller grid. The enhancement effect of the grid works here as well, as at the −1400 V level, it is presumably returning web secondary electrons back into the microchannels where they would otherwise be lost.

Tests using BSA ions as well as neutral species gave a dramatically enhanced detector signal for low-density KBr coatings regardless of the grid polarity used, as long as the field strength was approximately −200 V/mm. When the same deposition process was used to deposit low-density CsI onto MCP input faces, similar results were obtained. As with low-density KBr, the effect of using a repeller grid was found to be significant for both positive and negative polarities. Furthermore, for low-density CsI, when the grid was used, this helped increase sensitivity to high mass ions, and not for lower mass ions from Substance P. Interestingly, at least for CsI, moisture absorption had an effect. When the coating was exposed to atmospheric moisture, only a negative grid polarity offered any enhancement, suggesting that any secondary ions resulting from the primary ion impact may somehow be suppressed when water or hydroxyl molecules are present, with only secondary electrons being generated.

When the thin-layer KBr-coated MCP detectors were retested using a grid, all samples continued to show enhanced high-mass ion response compared with the standard uncoated MCP detectors. Negative repeller grid polarity showed greater signal strength compared with a positive grid voltage. Also both polarities performed better than having a zero voltage. Tests with uncoated MCP detectors did not show the strong voltage-dependent differences seen with coated MCP detectors.

The results clearly show that a field grid placed in close proximity to the MCP input face significantly enhances detection efficiency for high mass ions.

Example 2

MCP Detector Face Coatings

Figure 17:
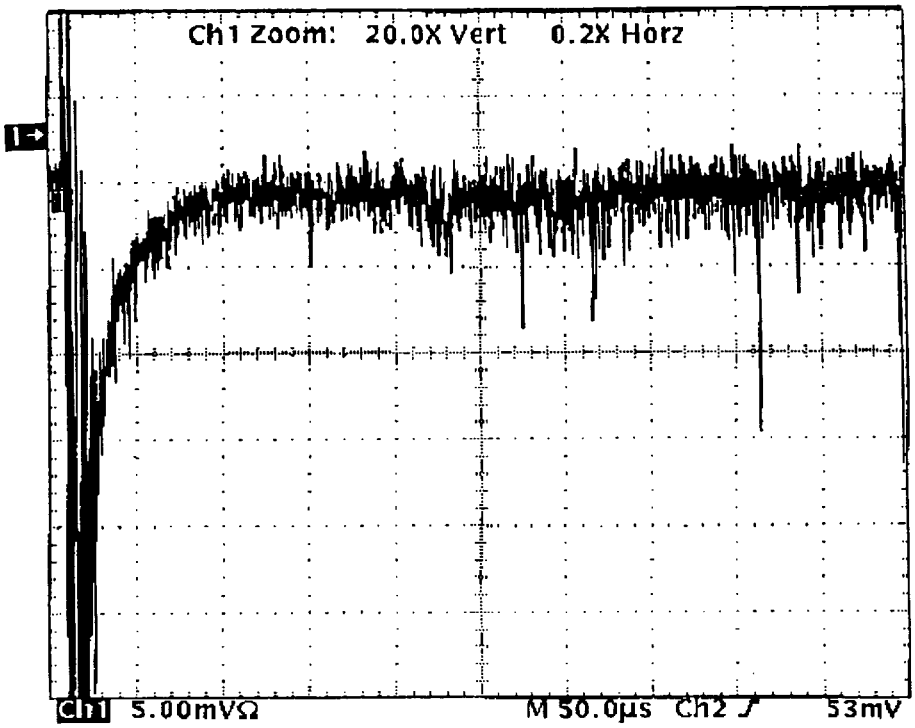
FIG. 17 is a mass spectrum for BSA with an uncoated detector face.
Figure 18:
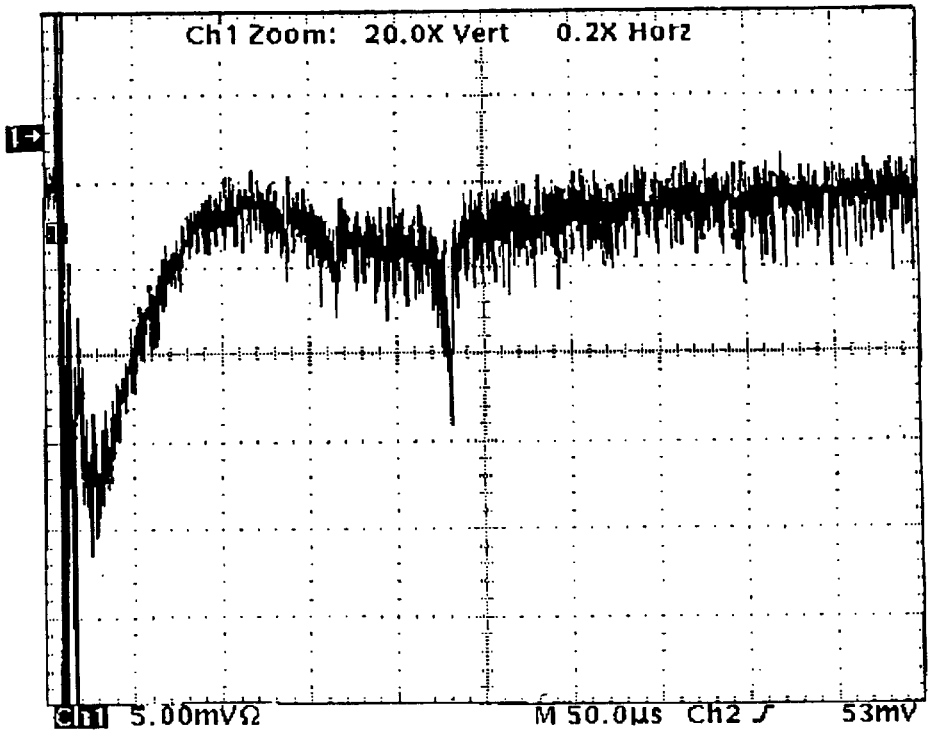
FIG. 18 is a mass spectrum for BSA according to a particular embodiment of the invention.

MCP detector faces were prepared having standard thin-film coatings, "fluffy" coatings and no coating. MALDI testing was carried out FIG. 17 shows a mass spectrum for bovine serum albumin (BSA) at 20 kV, using a standard (uncoated) 40:1 MCP. No grid voltage was imposed, to isolate the effect of the coating on detector sensitivity. The BSA signal is extremely weak, and almost imperceptible compared to the spectrum noise. FIG. 18 shows a spectrum taken immediately afterwards in the same mass spectrometer, using a "fluffy" KBr-coated MCP detector, prepared with a coating having a low-density and a thickness of approximately 5–10 $\mu$m. The spectrum is markedly improved.

Figure 19:
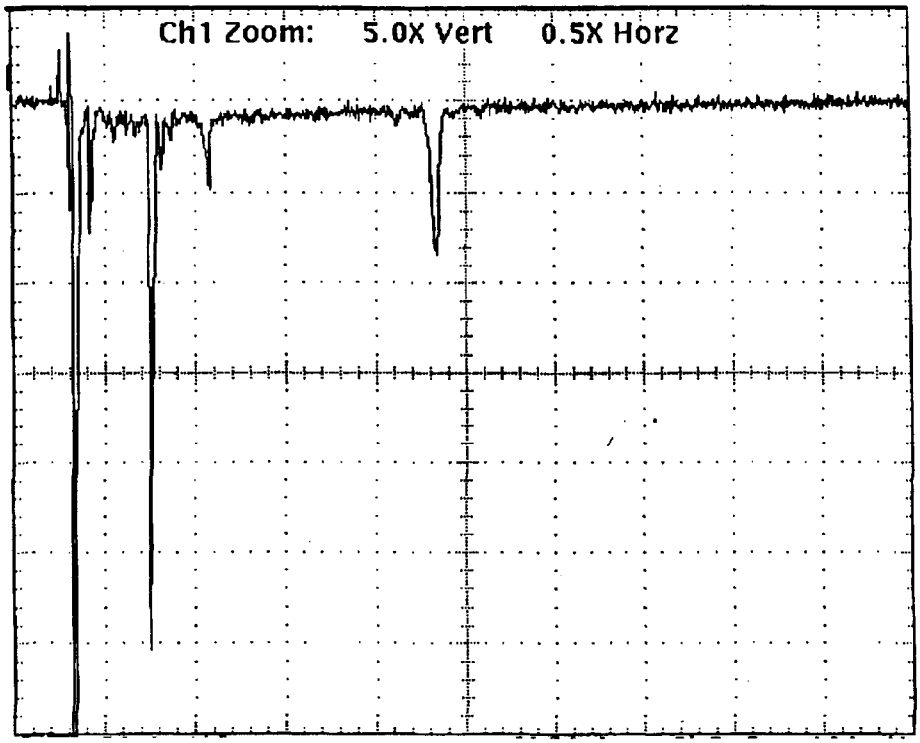
FIG. 19 is a mass spectrum for Substance P with a thin CuI film detector coating.
Figure 20:
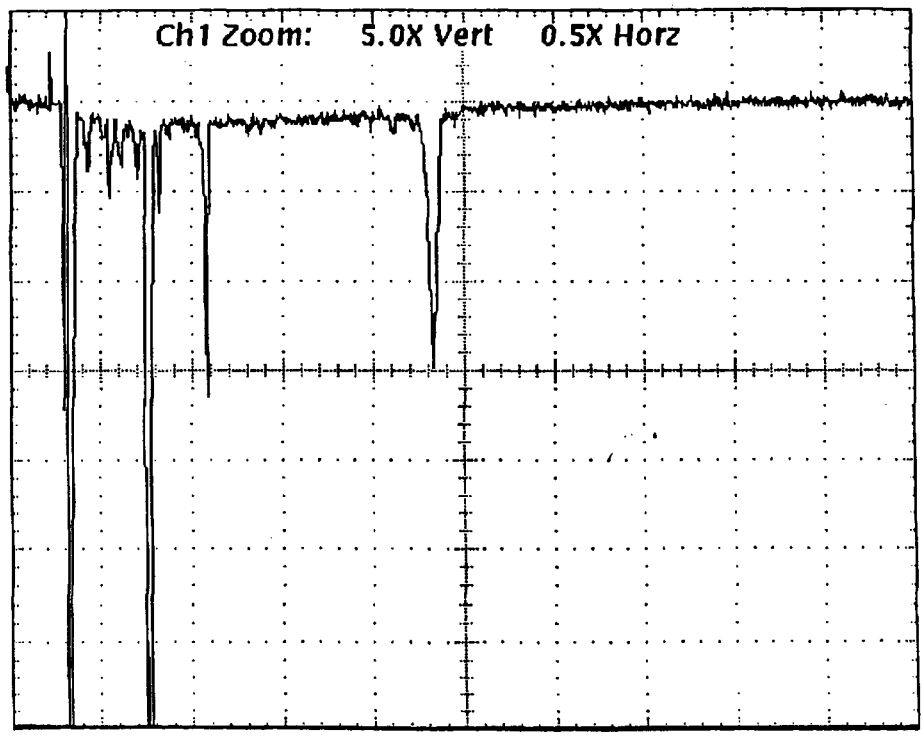
FIG. 20 is a mass spectrum for Substance P with a thin $MgF_2$ film detector coating.
Figure 21:
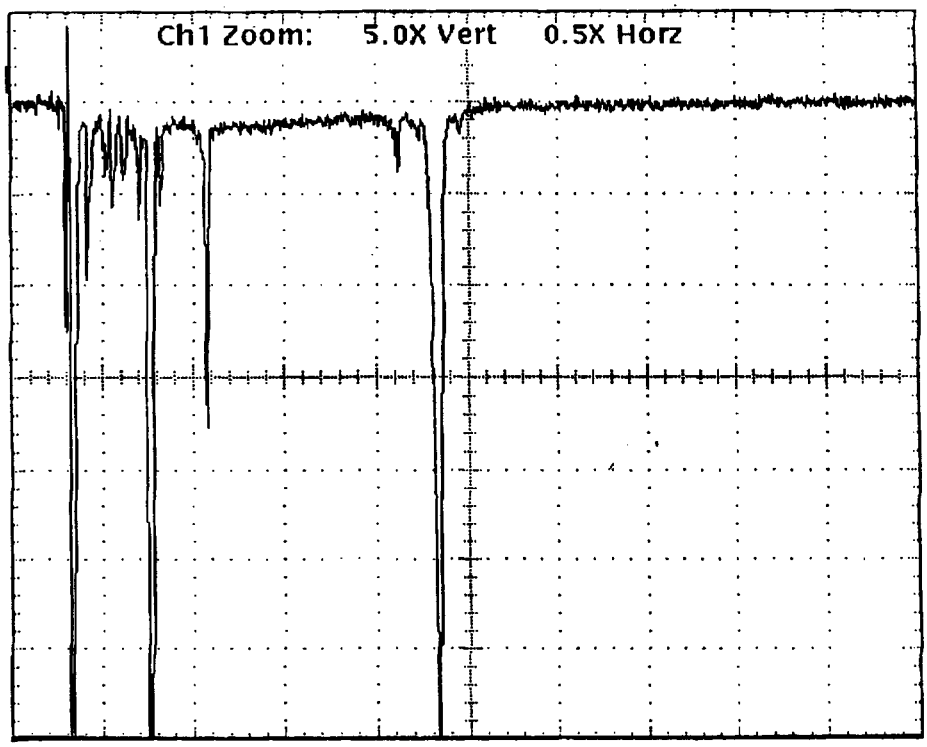
FIG. 21 is a mass spectrum for Substance P with a thin KBr film detector coating.
Figure 22:
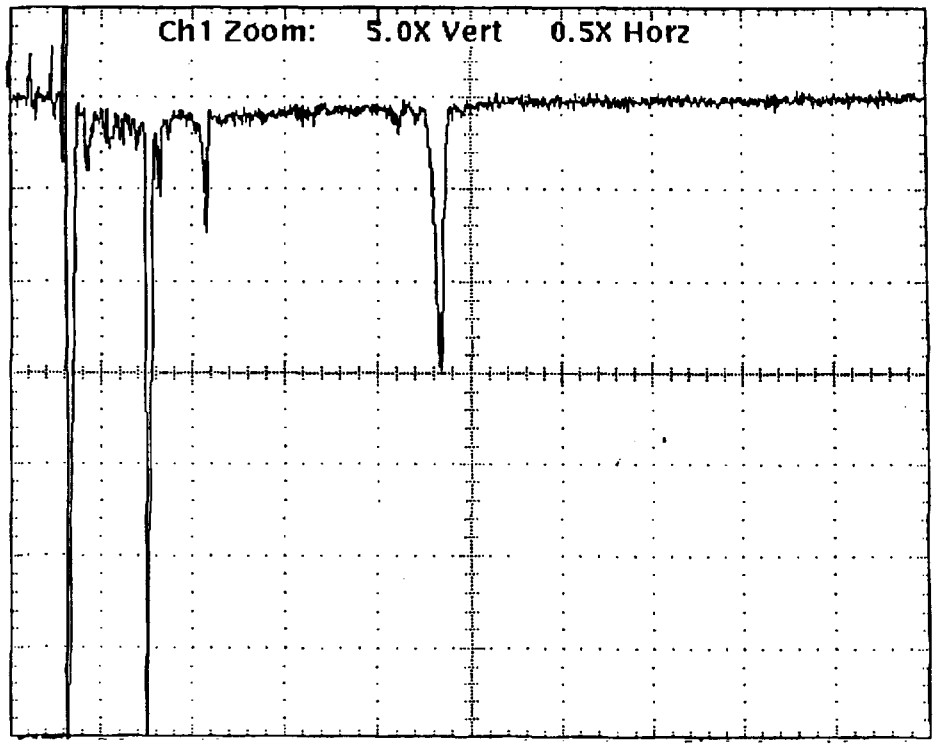
FIG. 22 is a mass spectrum for Substance P with an uncoated detector.

Testing with Substance P was also carried out. The accelerating voltage was 2.5 kV. FIG. 19 shows the mass spectrum using a standard thin film coating of CuI on the MCP detector face. FIG. 20 shows the mass spectrum using a standard thin film coating of $MgF_2$ on the MCP detector face. FIG. 21 shows the mass spectrum using a standard thin film coating of KBr on the MCP detector face, while FIG. 22 shows the mass spectrum of an uncoated MCP detector face. The superiority of KBr over the other coatings for this low velocity (that is, 2.5 kV) Substance P is evident, and consistent with repeated experiments with this MCP detector face coating.

Decay of in-flight ions can result in a certain fraction of the incoming analyte to be composed of neutral molecules. These will be detected by MCP with an efficiency which can be comparable to positive ions. AC coupling of the chevron detector was substituted in the tests, instead of the normal DC coupling used to detect positive analyte ions. This allowed the leading MCP voltage to be biased to a more positive potential than the incoming ion energy, thus repelling the charged positive ions and allowing only neutral molecules to impact the detector. Neutral ions of BSA could not be preferentially extracted due to the biasing method used, where the leading MCP detector surface had to be biased at a higher positive voltage than the incoming molecules.

Figure 23:
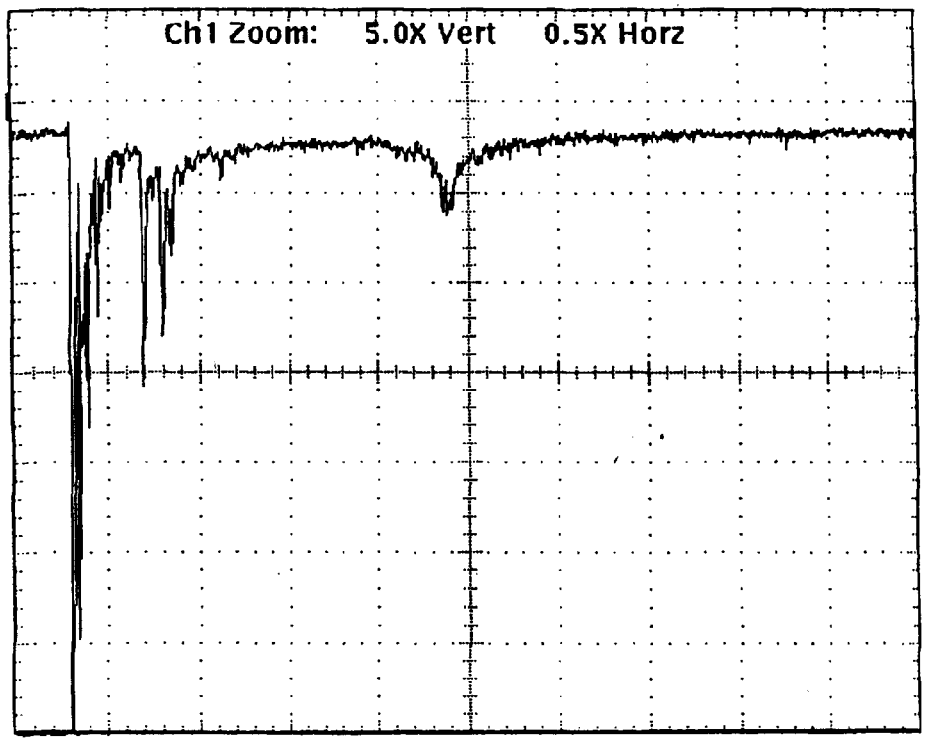
FIG. 23 is a mass spectrum for Substance P with a thin KBr film detector coating.
Figure 24:
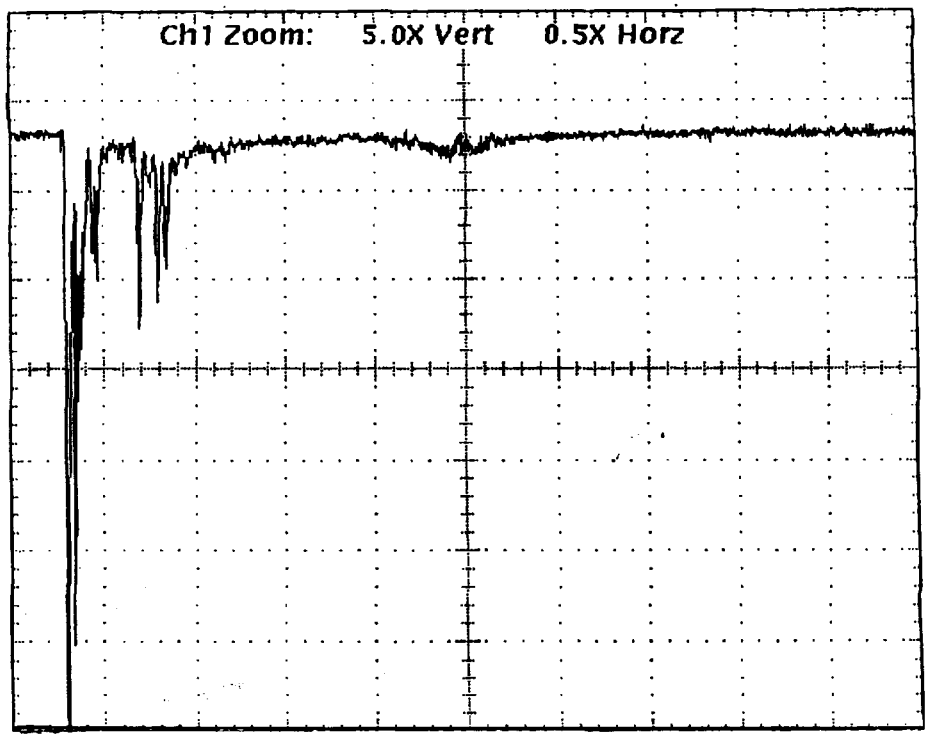
FIG. 24 is a mass spectrum for Substance P with a thin CuI film detector coating.
Figure 25:
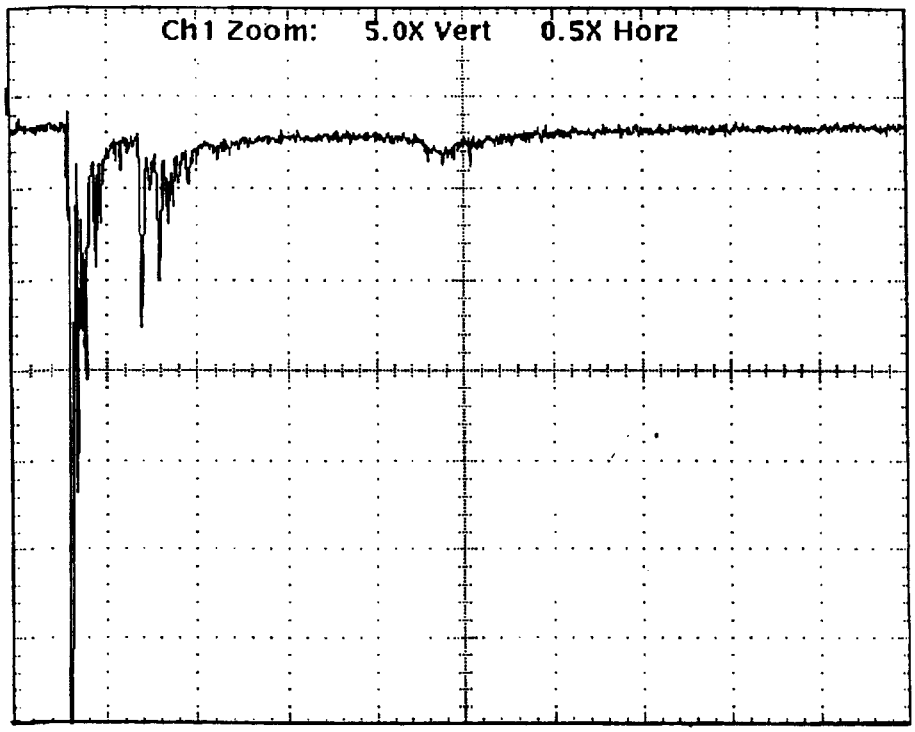
FIG. 25 is a mass spectrum for Substance P with a thin $MgF_2$ film detector coating.
Figure 26:
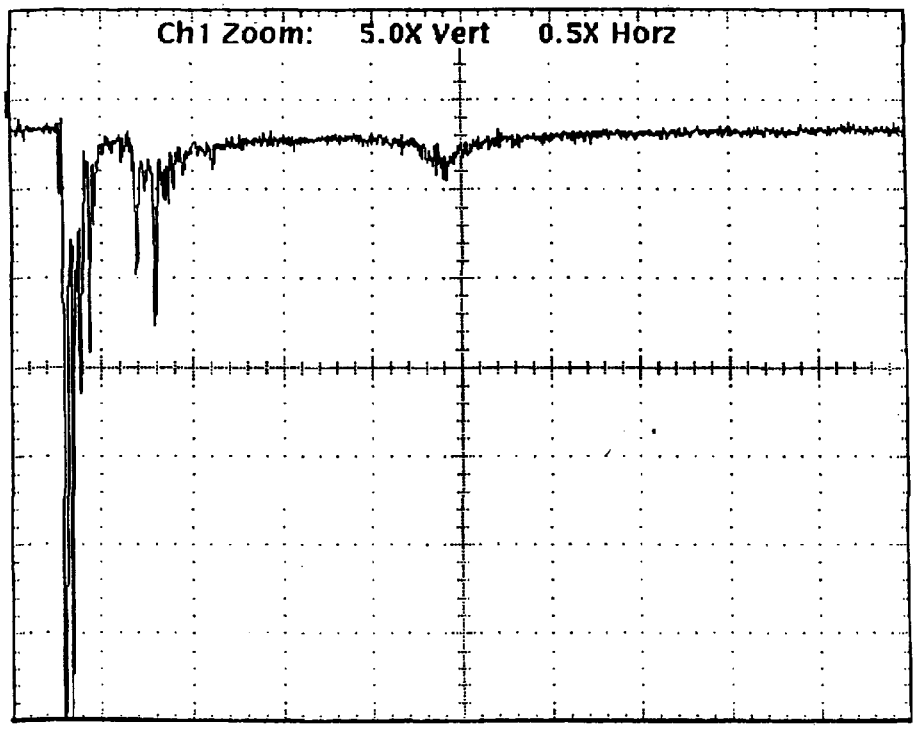
FIG. 26 is a mass spectrum for Substance P with an uncoated detector.

Testing of several different coated MCP detectors was carried out with neutral primary fragments of Substance P at 2.5 kV. Coatings were carried out to give 3.0 $\mu$m thick, unannealed deposits on the detector face. The leading MCP voltage was set at 800 V, as usual. All MCP detectors were identical except for the type of detector face coating. FIG. 23 shows the mass spectrum using a standard thin film coating of KBr on the MCP detector face. FIG. 24 shows the mass spectrum using a standard thin film coating of CuI on the MCP detector face. FIG. 25 shows the mass spectrum using a standard thin film coating of $MgF_2$ on the MCP detector face, while FIG. 26 shows the mass spectrum of an uncoated MCP detector face. The greatest sensitivity to neutral species was shown by the thin-film KBr coating, further confirming the superiority of KBr generally observed.

Figure 27:
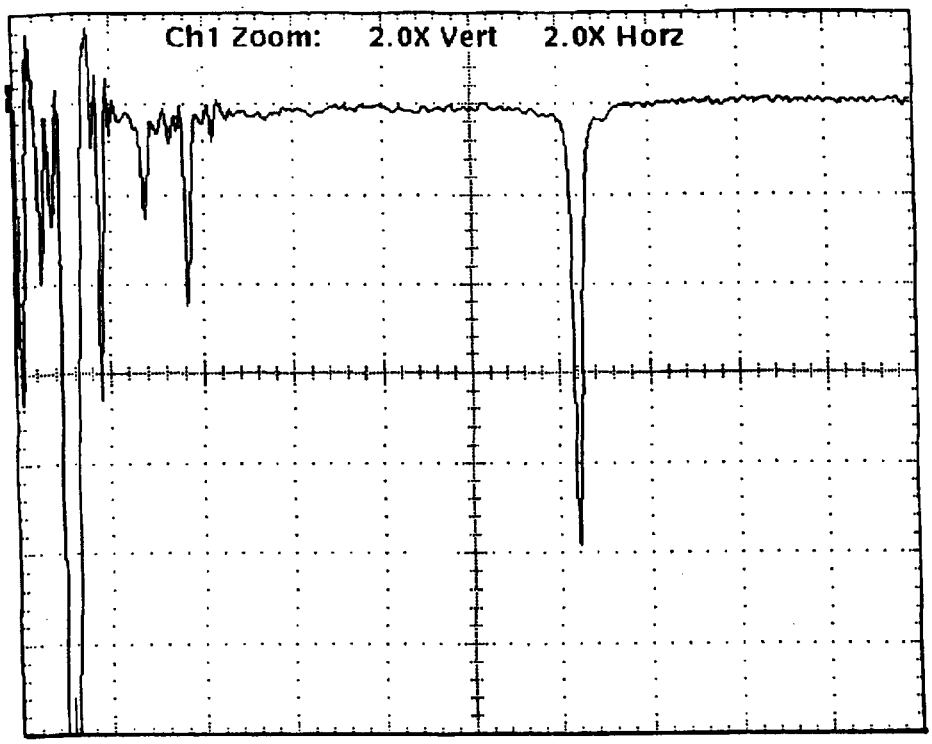
FIG. 27 is a mass spectrum for Substance P with a detector coating according to a particular embodiment of the invention.
Figure 28:
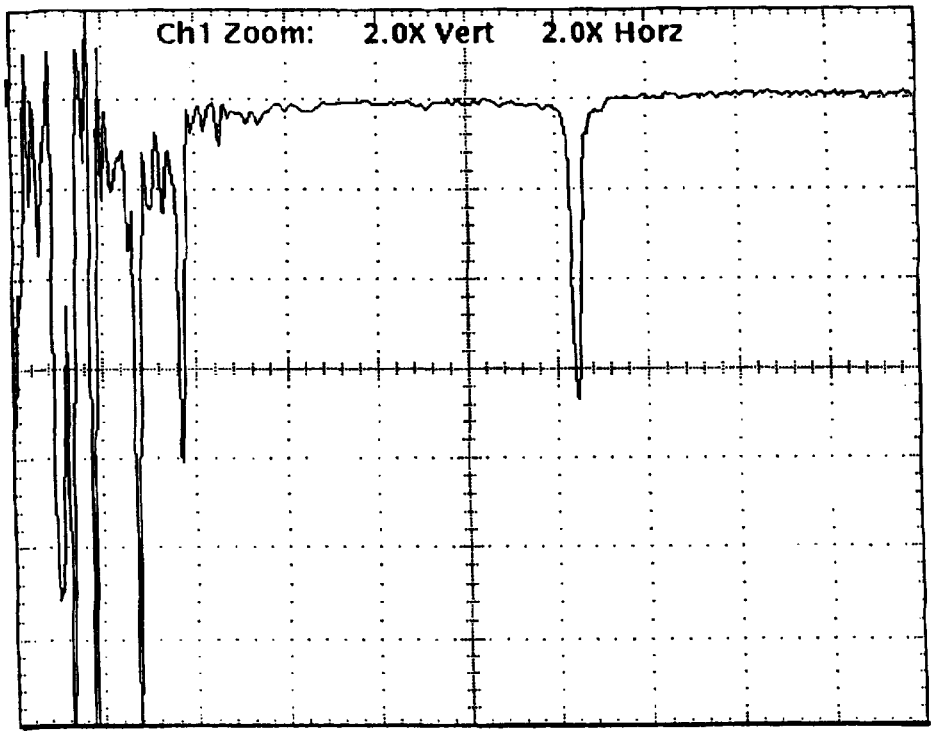
FIG. 28 is a mass spectrum for Substance P with an uncoated detector.
Figure 29:
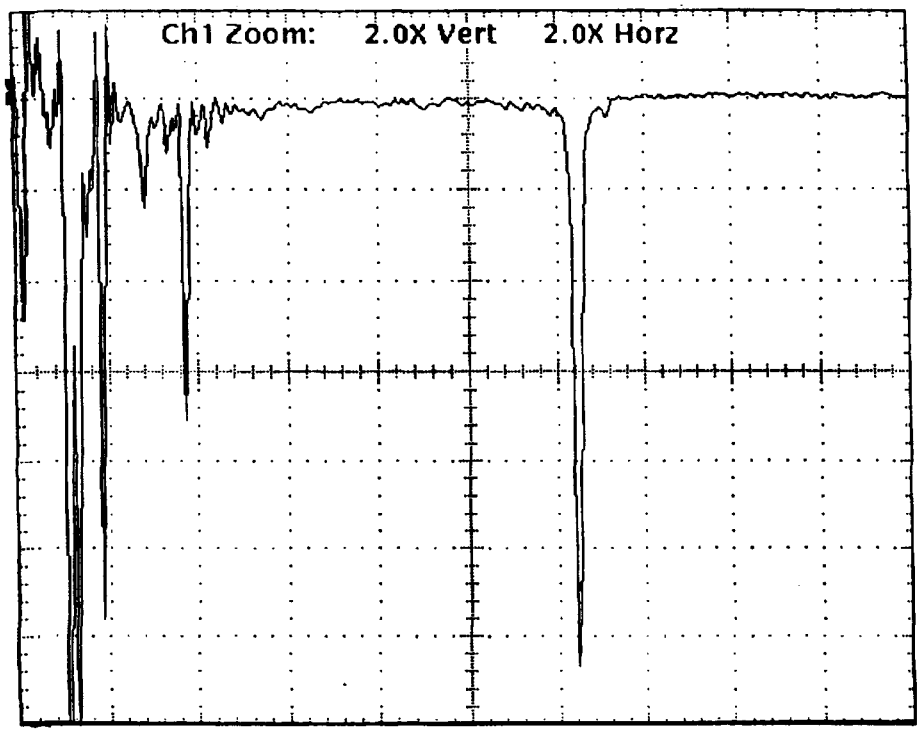
FIG. 29 is a mass spectrum for Substance P with a detector coating according to a particular embodiment of the invention.
Figure 30:
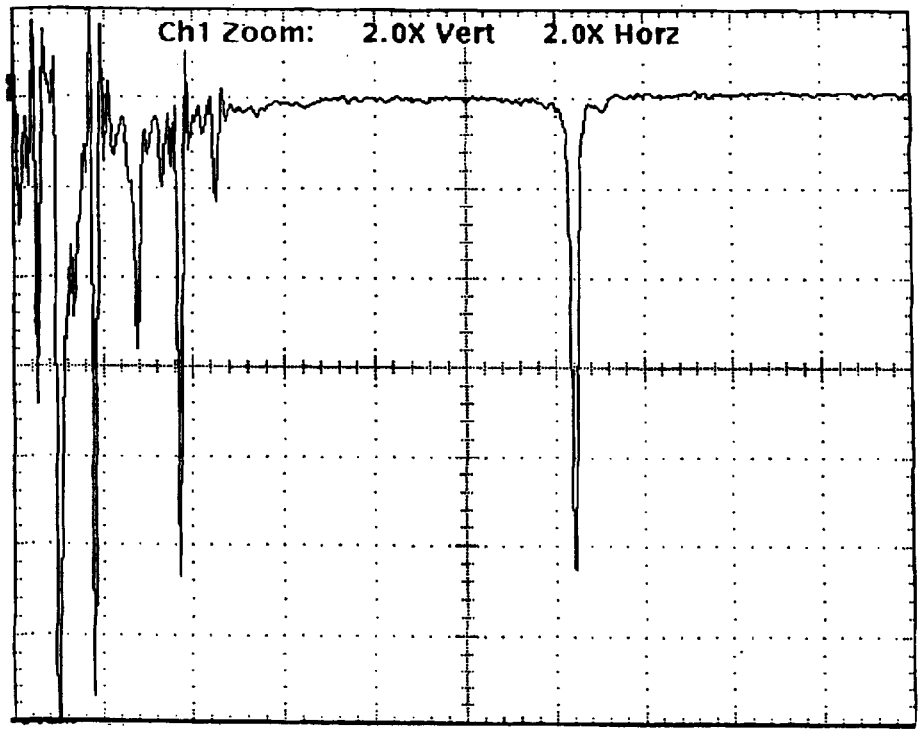
FIG. 30 is a mass spectrum for Substance P with an uncoated detector.
Figure 31:
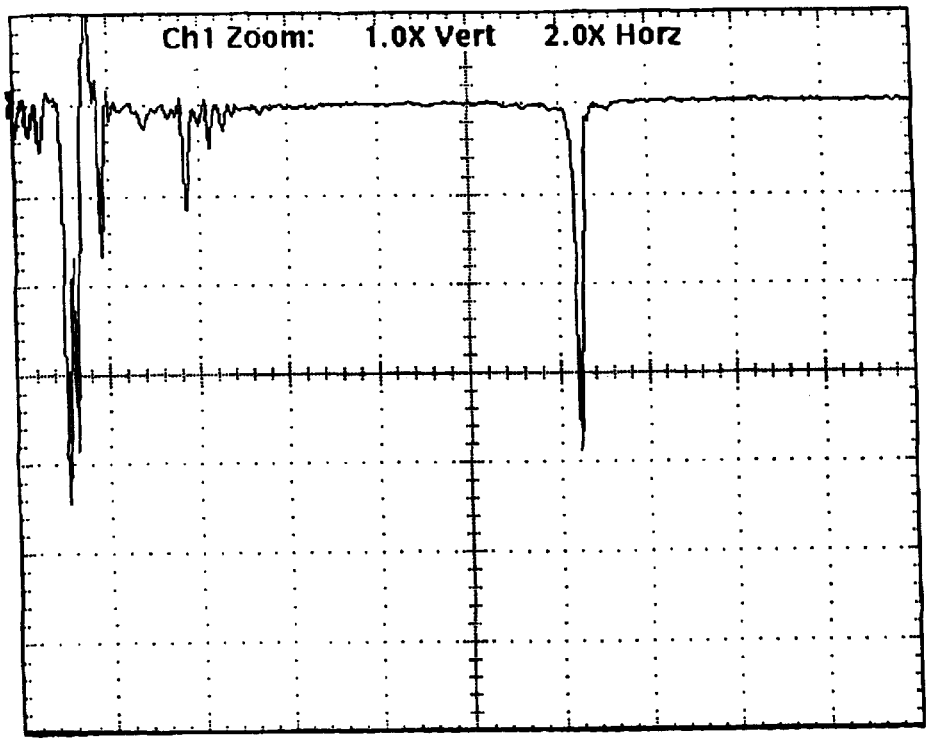
FIG. 31 is a mass spectrum for Substance P with a detector coating according to a particular embodiment of the invention.
Figure 32:
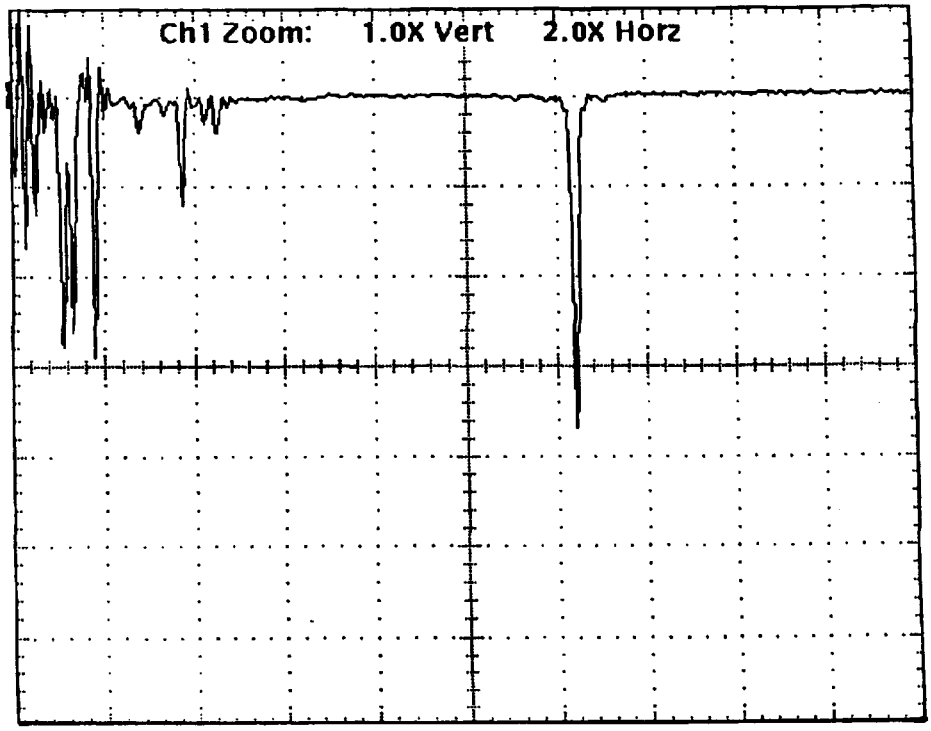
FIG. 32 is a mass spectrum for Substance P with an uncoated detector.
Figure 33:
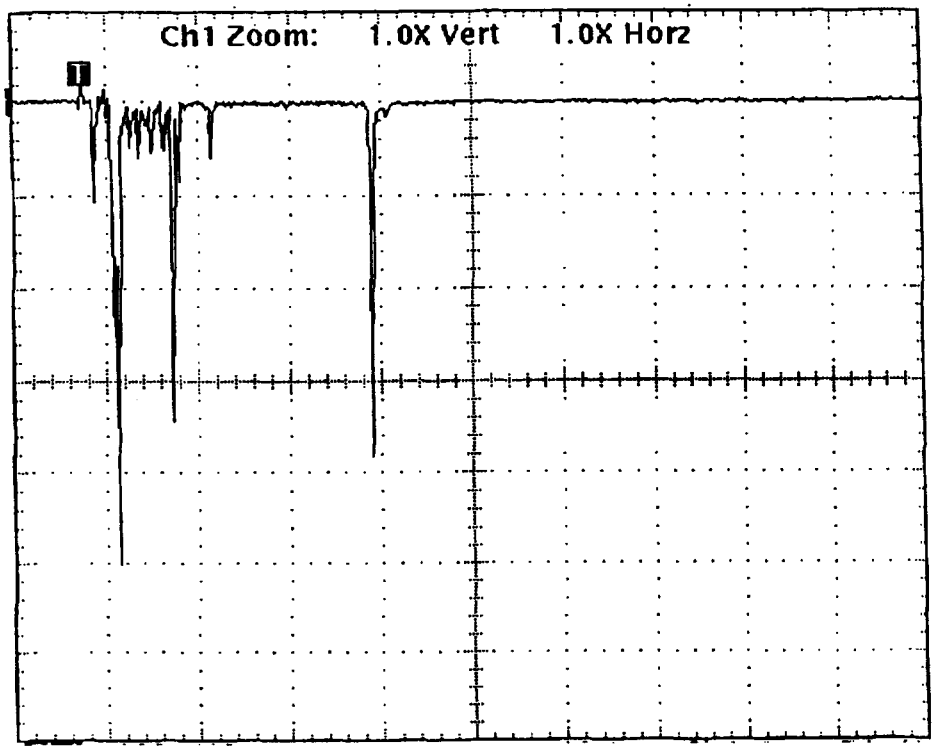
FIG. 33 is a mass spectrum for Substance P with a detector coating according to a particular embodiment of the invention.
Figure 34:
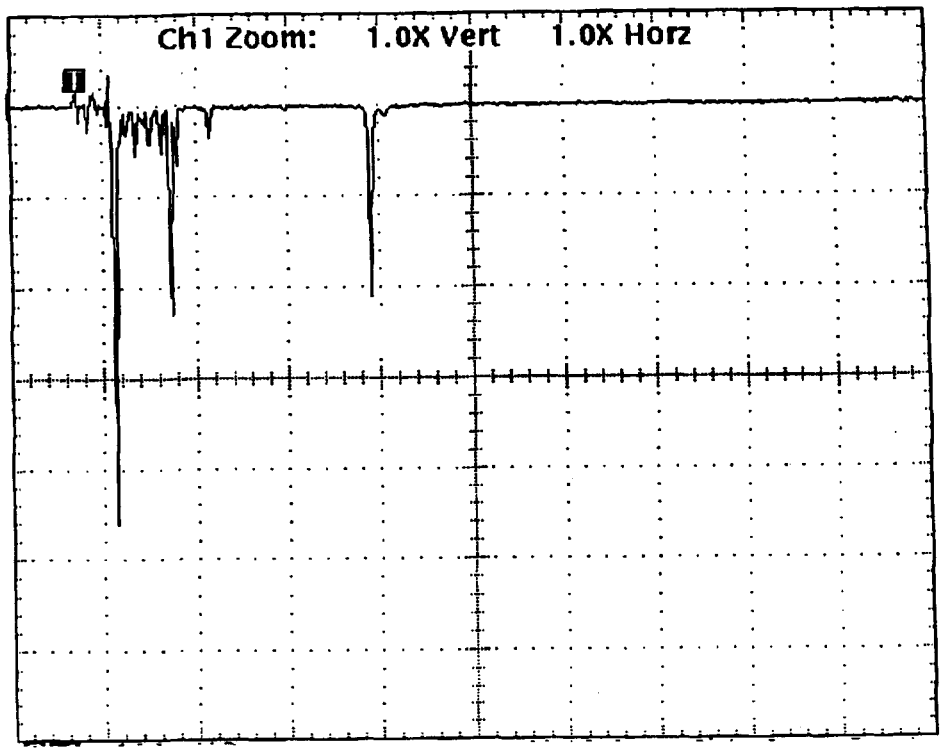
FIG. 34 is a mass spectrum for Substance P with an uncoated detector.

"Fluffy" coatings were further investigated for different deposition times. The effect of high mass ion detection was investigated for coating deposition times of 1, 2 and 4 minutes for Substance P. FIG. 27 shows the mass spectrum of Substance P at 20 kV accelerating voltage, for a 1 minute fluffy KBr deposition, while FIG. 28 shows the mass spectrum using an uncoated MCP detector face. There is a clear enhancement for the fluffy KBr spectrum. FIG. 29 shows the mass spectrum arising from a 2 minute deposited fluffy KBr coating, using Substance P, and FIG. 30 shows the comparison mass spectrum for an uncoated MCP detector face. The 4 minute deposition of fluffy KBr is shown in FIG. 31, and the uncoated MCP detector face is shown in FIG. 32, showing the smallest relative difference. For the Substance P set of data, the one minute fluffy KBr deposition gave the best improvement of spectral sensitivity over the uncoated MCP. FIG. 33 shows the mass spectrum for Substance P at 20 kV, for a 5 minute deposition of fluffy KBr, and FIG. 34 shows the mass spectrum for an uncoated MCP detector face. The superiority of this coating is evident once again.

Tests using BSA as analyte were less satisfactory, in that generally, the uncoated MCP detector gave a better response than the coated MCP detector, a result opposite that for Substance P. Fluffy CsI was also investigated. The mass spectrum of a 4 minute deposition of fluffy CsI with BSA run at 20 kV acceleration voltage was compared with that of an uncoated MCP detector face, and the uncoated mass spectrum showed superior sensitivity to this analyte.

Figure 35:
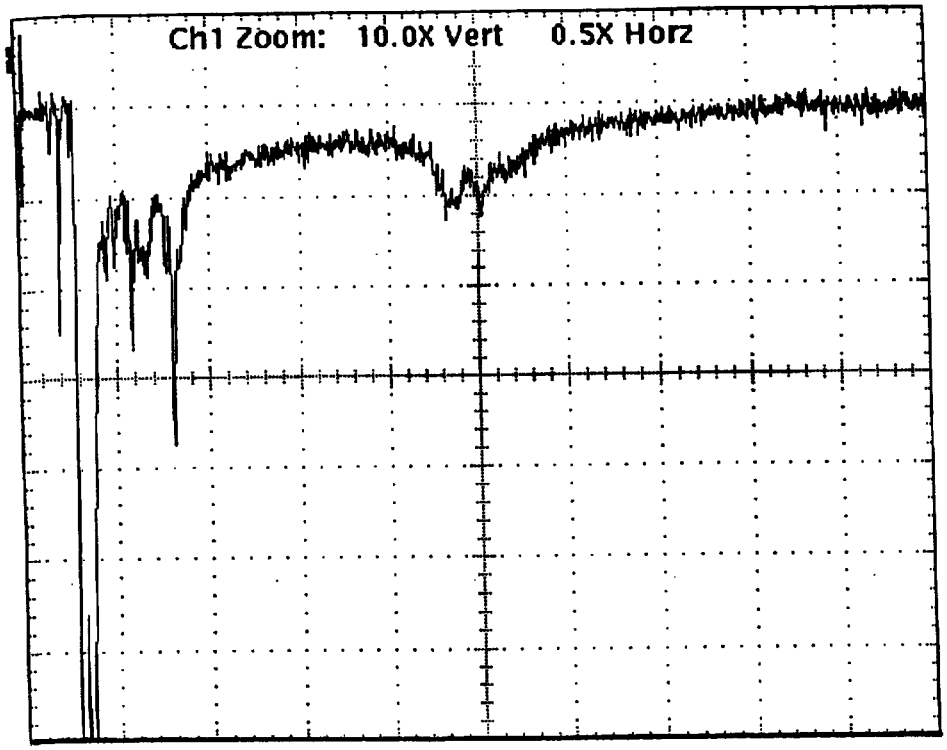
FIG. 35 is a mass spectrum for Substance P with a detector coating according to a particular embodiment of the invention.
Figure 36:
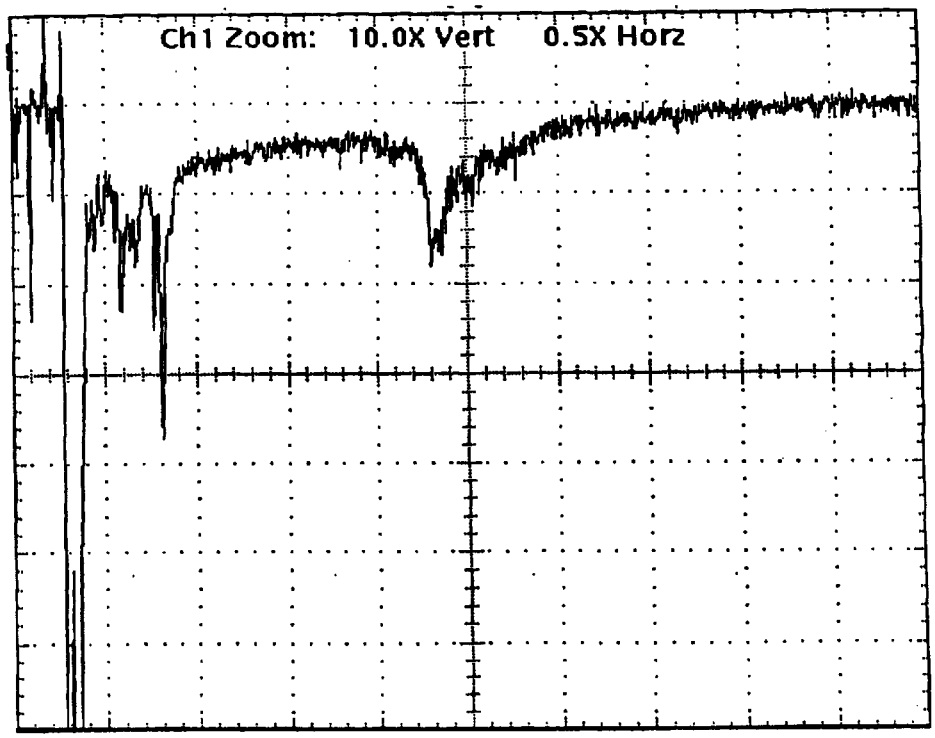
FIG. 36 is a mass spectrum for Substance P with a detector coating according to a particular embodiment of the invention.
Figure 37:
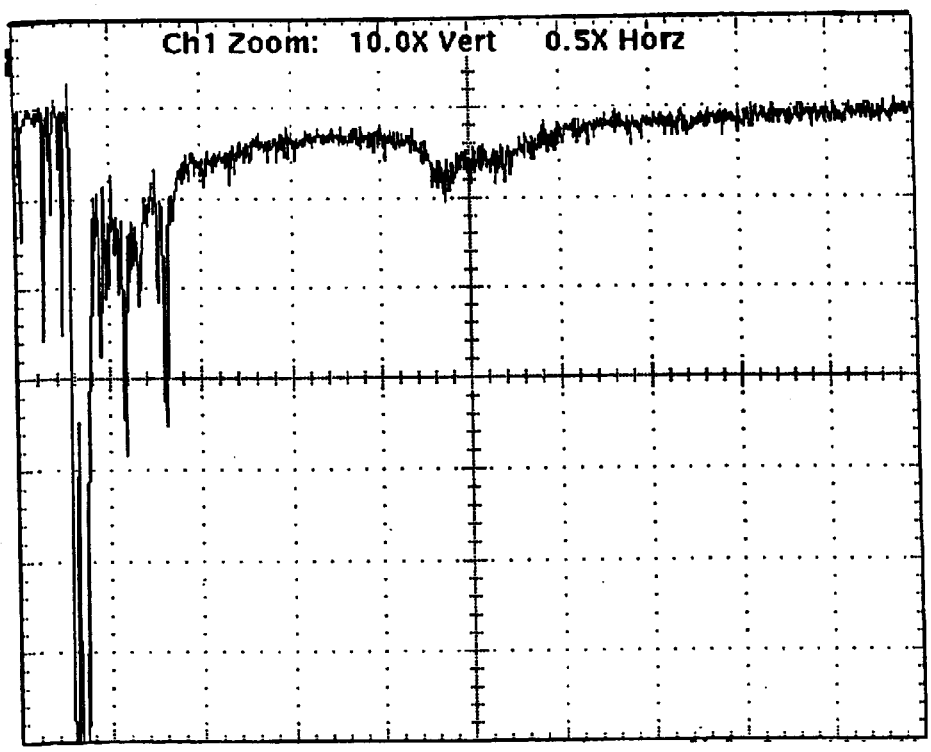
FIG. 37 is a mass spectrum for Substance P with an uncoated detector.

Fluffy KBr and CsI coatings were also investigated for the detection of neutral species, using Substance P at 2.5 kV. The response of a fluffy CsI-coated MCP detector face is shown in FIG. 35, that of a fluffy KBr-coated MCP detector face in FIG. 36, and an uncoated MCP detector face in FIG. 37, with the uncoated mass spectrum showing the worst results, and fluffy KBr, the best.

The data show that a "fluffy" MCP coating shows superior sensitivity to high mass ions, as compared to standard thin film MCP coatings.

Example 3

Negative Interplate Bias

The following data show the improvement resulting from a negative interplate bias voltage between two standard 40:1 MCP in a chevron configuration.

Figure 38:
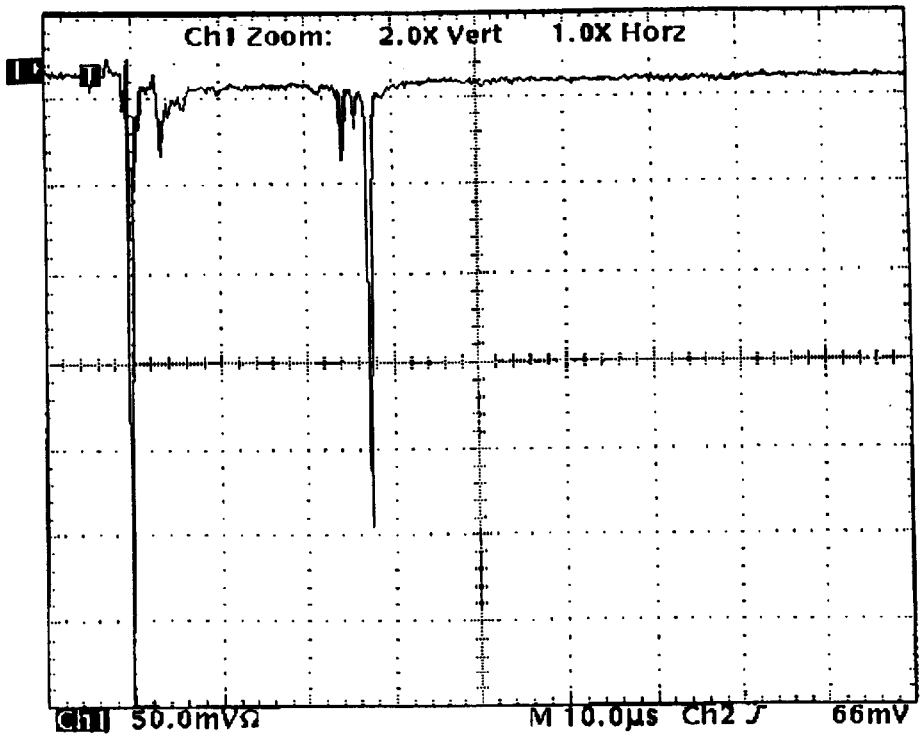
FIG. 38 is a mass spectrum for Substance P with no interplate bias voltage.
Figure 39:
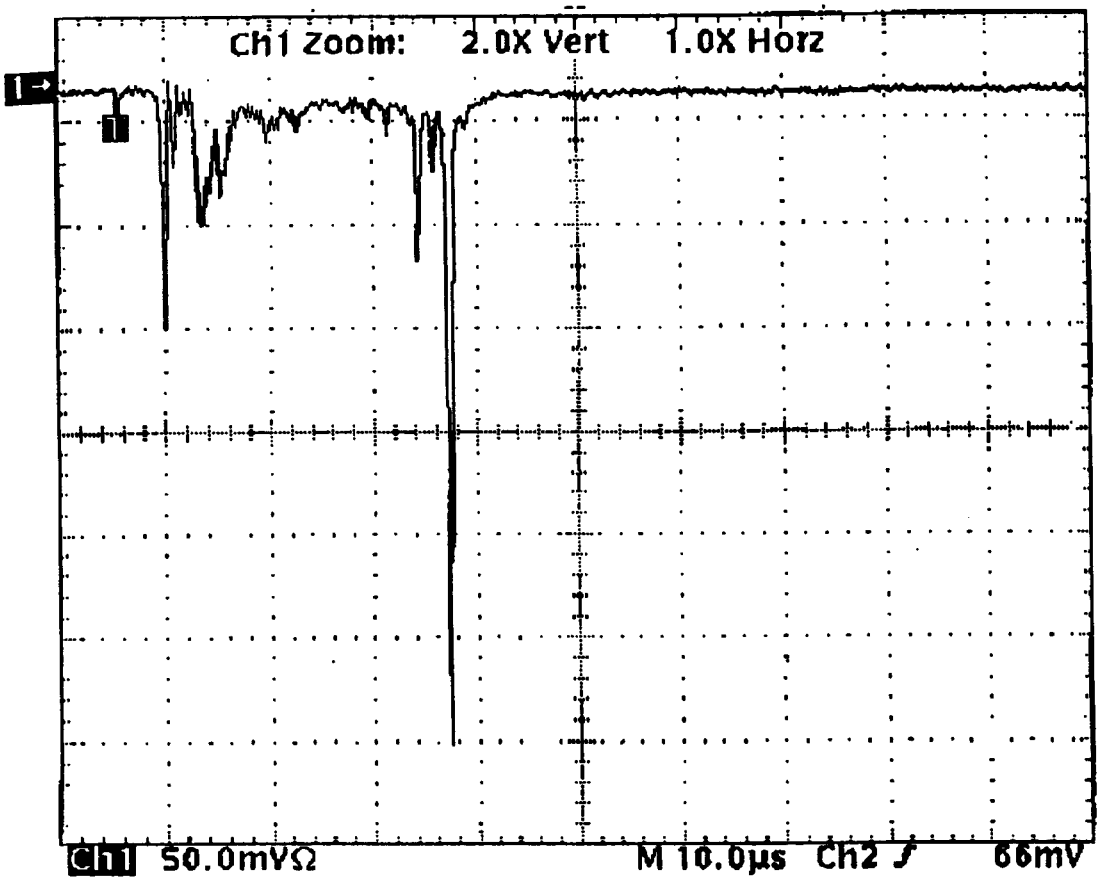
FIG. 39 is a mass spectrum for Substance P according to a particular embodiment of the invention.

FIG. 38 shows a mass spectrum of Substance P taken with the interplate bias of 0 V. FIG. 39 shows a mass spectrum taken with the interplate bias of −200 V. Note that, at −200 V, the low mass matrix ion peak at the left of the spectrum has been significantly diminished in signal amplitude, while the higher mass (Substance P) peak has actually increased in amplitude.

The results indicate the superiority of biasing the interplate at a negative potential. In practice, lowering the lower mass signal would lower the degree of paralysis of the rear MCP microchannels, allowing many more channels to remain active for registering the later-arriving high mass signal ions.

It is to be understood that while the invention has been described in conjunction with the detailed description thereof, the forgoing description is intended to illustrate and not limit the scope of the invention, which is defined by the scope of the appended claims. Other aspects, advantages, and modifications are within the scope of the following claims.

What is claimed is:

1. A detection system for the detection of molecules and molecular fragments, said system comprising:

(a) a beam of charged and neutral molecules and molecular fragments;

(b) a first detector for receiving said beam, wherein said first detector produces a first cascade of electrons which can be detected to produce a first detection signal, and wherein said first detector comprises a detector face, said first detector face having an external surface upon which molecules and molecular fragments directly impinge, wherein said external surface is coated with a low work function material present at a surface mass density of between about 50 $\mu g/cm^2$ and about 2000 $\mu g/cm^2$;

(c) a repeller grid positioned directly in the path of said beam, wherein said grid produces an electric field experienced by said charged molecules and molecular fragments; and (d) an analyzer capable of correlating a signal from said detector with the molecular weights of said molecules and molecular fragments.

2. The detection system of claim 1, wherein said low work function material is selected from the group consisting of group IA and group IIA halide salts and copper iodide.

3. The detection system of claim 2, wherein said low work function material is selected from the group consisting of CsI, CsBr, CsCl, KBr, KI, KCl, RbI, RbBr, RbCl, LiF, and $MgF_2$.

4. The detection system of claim 1, wherein the thickness of said low work function material is between about 3 $\mu m$ and about 10 $\mu m$.

5. The detection system of claim 1, wherein said electric field is a negative electric field.

6. The detection system of claim 1, wherein said electric field is a positive electric field.

7. The detection system of claim 1, further comprising:

(d) a second detector positioned behind said first detector which is adapted to receive said first cascade of electrons from said first detector, wherein said second detector produces a second cascade of electrons which can be detected to produce a second detection signal, wherein said second detection signal is greater than said first detection signal; and (e) an electric field between said first detector and said second detector experienced by said first cascade of electrons.

8. The detection system of claim 1 included in a time-of-flight mass spectrometer.

9. The detection system of claim 1 including a MALDI ionization system.

10. The detection system of claim 1, wherein the low work function material has a work function below about 3.5 eV.

11. The detection system of claim 1, wherein the low work function material has a work function below about 3.0 eV.

12. The detection system of claim 1, wherein the low work function material has a work function below about 2.8 eV.

13. The detection system of claim 1, wherein the low work function material comprises KBr.

14. A mass spectrometer comprising a microchannel plate detector, wherein said detector comprises an external surface coated with a low work function material present at a surface mass density of between about 50 $\mu g/cm^2$ and about 2000 $\mu g/cm^2$.

15. The mass spectrometer of claim 14, wherein said low work function material is selected from the group consisting of group IA and group IIA halide salts and copper iodide.

16. The mass spectrometer of claim 14, wherein said low work function material is selected from the group consisting of CsI, CsBr, CsCl, KBr, Kl, KCl, RbI, RbBr, RbCl, LiF, and MgF2.

17. A time-of-flight mass spectrometer according to claim 14.

18. A mass spectrometer according to claim 14 which includes a MALDI ionization system.

19. The mass spectrometer of claim 14, wherein the low work function material has a work function below about 3.5 eV.

20. The mass spectrometer of claim 14, wherein the low work function material has a work function below about 3.0 eV.

21. The mass spectrometer of claim 14, wherein the low work function material has a work function below about 2.8 eV.

22. The mass spectrometer of claim 14, wherein the low work function material comprises KBr.

23. A method for detecting the mass of molecules or molecular fragments, said method comprising the steps of:

(a) providing a beam of charged and neutral molecules and molecular fragments;

(b) providing a first detector for receiving said beam, wherein said first detector produces a first cascade of electrons which can be detected to produce a first detection signal, and wherein said first detector comprises a detector face, said first detector face having an external surface upon which molecules and molecular fragments directly impinge, wherein said external surface is coated with a low work function material present at a surface mass density of between about 50 $\mu g/cm^2$ and about 2000 $\mu g/cm^2$;

(c) providing a repeller grid positioned directly in the path of said beam, wherein said grid produces an electric field experienced by said charged molecules and molecular fragments; and (d) analyzing said molecules or molecular fragments, said analysis comprising detecting the impingement of said molecules or molecular fragments impinging upon said first detector face, and correlating a signal from said detector with the molecular weights of said molecules and molecular fragments.

24. The method of claim 23 further comprising:

(e) providing a second detector positioned behind said first detector which is adapted to receive said first cascade of electrons from said first detector, wherein said second detector produces a second cascade of electrons which can be detected to produce a second detection signal, wherein said second detection signal is greater than said first detection signal; and (e) providing an electric field between said first detector and said second detector experienced by said first cascade of electrons.

25. The method of claim 23, wherein the low work function material has a work function below about 3.5 eV.

26. The method of claim 23, wherein the low work function material has a work function below about 3.0 eV.

27. The method of claim 23, wherein the low work function material has a work function below about 2.8 eV.

28. The method of claim 23, wherein the low work function material comprises KBr.

* * * * *